US009495941B2

(12) United States Patent
Stanley

(10) Patent No.: US 9,495,941 B2
(45) Date of Patent: Nov. 15, 2016

(54) TUNING MECHANISM

(71) Applicant: Stonefield International Limited, Christchurch (NZ)

(72) Inventor: Thomas James Stanley, Christchurch (NZ)

(73) Assignee: Stonefield International Limited, Ilam, Christchurch (NZ)

( * ) Notice: Subject to any disclaimer, the term of this patent is extended or adjusted under 35 U.S.C. 154(b) by 0 days.

(21) Appl. No.: 15/023,662

(22) PCT Filed: Sep. 25, 2014

(86) PCT No.: PCT/IB2014/064820

§ 371 (c)(1),
(2) Date: Mar. 21, 2016

(87) PCT Pub. No.: WO2015/044887

PCT Pub. Date: Apr. 2, 2015

(65) Prior Publication Data

US 2016/0240174 A1 Aug. 18, 2016

(30) Foreign Application Priority Data

Sep. 25, 2013 (NZ) ..... 615937

(51) Int. Cl.
*G10D 3/14* (2006.01)
*G10D 3/12* (2006.01)

(52) U.S. Cl.
CPC . *G10D 3/14* (2013.01); *G10D 3/12* (2013.01)

(58) Field of Classification Search
CPC ..... G10D 3/14; G10D 1/08; G10D 3/143; G10D 3/12; G10D 1/00; G10D 3/06; G10D 3/006; G10D 3/04; G10D 3/146; G10G 7/02; G10H 1/44
USPC ..... 84/304, 312 R, 290
See application file for complete search history.

(56) References Cited

U.S. PATENT DOCUMENTS 4,608,904 A 9/1986 Steinberger
(Continued)

FOREIGN PATENT DOCUMENTS

WO 2012/022969 A2 2/2012

OTHER PUBLICATIONS

International Search Report and Written Opinion dated Feb. 18, 2015, International Patent Application No. PCT/IB2014/064820 with International Filing date of Sep. 25, 2014, (9 pages).

*Primary Examiner* — Kimberly Lockett
(74) *Attorney, Agent, or Firm* — Stephen M. De Klerk

(57) ABSTRACT

A tuning mechanism (1) for a stringed instrument (2), including: a body (3); a neck (4) extending from the body (3); strings (5) secured to a headstock (6) by a headstock string retainer (7) and to the body (3) by a tailpiece (8). The strings (5) are tensioned over a span formed between a first (10) and a second string supports (11), respectively located on the body (3) and at, or adjacent, the headstock (6). The tuning mechanism (1) includes a manually adjustable tensioning mechanism (13), locatable on the body (3) and connected to at least one movable string deflector (14), contacting a string (5) between the first string support (10) and the tailpiece (8) along a deflection path (28) co-incident with the longitudinal axis of the string (5) between the first string support (10) and the tailpiece (8). Tensioning mechanism (13) adjustment produces a commensurate string deflector (14) movement generating lateral deflection of the string (5) along the deflection path (29) from contact with the string deflector (14).

20 Claims, 25 Drawing Sheets

(56) References Cited

U.S. PATENT DOCUMENTS

| | | | | |
|---|---|---|---|---|
| 4,632,005 | A * | 12/1986 | Steinberger | G10D 3/146 84/297 S |
| 4,688,461 | A | 8/1987 | Stroh | |
| 4,712,463 | A | 12/1987 | Kubicki et al. | |
| 5,198,601 | A * | 3/1993 | McCabe | G10D 3/146 84/298 |
| 5,539,143 | A | 7/1996 | Rose | |
| 6,184,450 | B1 | 2/2001 | Leblanc | |
| 7,071,398 | B2 | 7/2006 | Hannes | |

* cited by examiner

TUNING MECHANISM

CROSS-REFERENCE TO OTHER APPLICATIONS

This is a National Phase of International Application No. PCT/IB2014/064820 filed on Sept. 25, 2014, which claims priority from New Zealand Patent Application No. 615937, filed on Sept. 25, 2013.

TECHNICAL FIELD

The present invention relates to an apparatus for tuning stringed instruments and in particular, bass guitars.

BACKGROUND ART

Musical string instruments produce sound from vibrating strings and as such, form part of the wider classification group of chordophones, being any instrument producing sound from vibrating one or more strings tensioned between two points. Multi-stringed instruments such as a guitar, electric bass, violin, viola, cello, double bass, banjo, mandolin, rabab, sitar, ukulele, bağlama and, bouzouki provide the capacity for a corresponding multiplicity of separate notes to be played by virtue of different string lengths, type and applied tension. In order to produce or maintain the desired pitch for each string, the tension must be adjusted by some form of tuning mechanism or feature.

Although the construction and configuration of such string instruments varies according to type, taste and performance criteria, a typical guitar (described herein for reference purposes) embodies much of the common features between instruments of this type.

A typical guitar is formed from a body section to which one end of each string is attached via a fitting known as a tailpiece. The strings extend from the tailpiece over a transverse support known as a bridge which displaces the strings away from the body section. The bridge also maintains the strings with a substantially equidistant transverse spacing by respective placement of the strings in transversely spaced notches. Prior art guitars include configurations where the bridge and tailpiece are formed as an integral unit or as two disparate components.

The guitar includes an elongate neck extending from a proximal end at the body section to a distal end known as a headstock. The junction between the neck and the headstock is demarcated by a second transverse support known as the nut. The strings each extend from the bridge over, and substantially parallel to, the surface of the body section and neck to the nut before being deflected at an obtuse angle towards a corresponding means of securement. The nut is configured with transverse notches to retain the string's transverse placement in a comparable manner to the bridge.

While nylon strings may be simply tied off at the tailpiece, a guitar using steel strings typically secures the strings at the tailpiece by a ball end, consisting of a cylindrical brass or steel sleeve over which the end of the string is wrapped.

A widely implemented prior art tuning configuration involves securing the ball end of a string to some form of anchorage at the tailpiece and passing the other end of the string through an aperture in a post in a mechanical tuning mechanism situated on the headstock of the instrument.

The most widespread tuning mechanisms used on the headstock of guitars, banjos, bass guitars are either non-geared (known as tuning pegs) or geared, consisting of;

an aperture, capstan or post, attached to a pinion gear, a worm gear, acting orthogonally on the pinion, a finger-operated button or knob at the end of the worm gear.

The string passes through the aperture in the capstan and is rotated via the worm gear by the tuning knob. The user is thus able to vary the tension on the string by corresponding adjustment of the string tension by appropriate rotation of the tuning knob.

The additional mass of the tuning mechanism at the end of the guitar neck/headstock undermines the stability of the guitar by moving the centre of balance towards the headstock. The compromised balance of the guitar is further exacerbated when played in a standing position and held by a strap. Electric bass guitar are often produced with 4-6 steel strings of greater diameter and length (with correspondingly longer necks) than a standard guitar and thus the unbalancing effects of a headstock tuning mechanism are even more acute than a standard guitar.

To combat the destabilising effects of the torque exerted by the added mass of the headstock tuning mechanism requires bass players to either carry the neck with the fretting hand while playing or to adopt a characteristic range of postures with the non-fretting hand/arm to assist in balancing the instrument. Placing the weight of a mechanical, geared tuning mechanism in the tailpiece instead of the headstock assists in counteracting the aforesaid imbalance.

Tailpiece tuners by Steinberger (U.S. Pat. No. 4,608,904) and Kubicki et al (U.S. Pat. No. 4,712,463) attempt to address the above issues. However, disadvantages with Steinberger include the requirement for specialised strings with end fittings purpose-made to couple with the tailpiece tuner mechanism. Attempts to circumvent the need for such strings involve string clamps at the nut, though this requires additional tools to manipulate the small parts of the clamp, which are held in place by cap screws. Such manipulation requires a level of dexterity that can be difficult to attain when changing strings in performance environments, particularly in low light levels. Moreover, many users found the Steinberger tuning knobs difficult to rotate, requiring high force levels and were prone to becoming stuck if left unused for long periods.

Kubicki does allow the use of standard strings. However the tuning mechanism is rather large and visibly unorthodox in comparison to components typically found on such musical instruments. Guitarist and bassist have been found to exhibit predominantly conservative taste with regard to guitar design and unusual visual designs are not easily accepted. Furthermore, the size of the Kubicki tuner fitted to an electric bass necessitated an instrument's string length (referred to as scale length) of 32 inches, rather than an industry-standard 34 inches in order to produce an instrument of a standard overall length. Players predominantly prefer the feel of the string tension and the tonal qualities of a 34-inch scale. After the introduction of the highly successful Fender Precision™ Bass and the subsequent Fender Jazz™ bass guitars, manufacturers of bass guitars effectively settled on a de facto industry standard substantially corresponding to the dimensions of these instruments.

The dimensions of these two instruments have been widely recognised as the industry benchmarks for overall length, scale length and placement of componentry such as electronic controls, pick-ups, tailpieces bridges, headstock tuning mechanisms, etc.

Consequently, accessory markets such as bass guitar cases are heavily biased towards products that would accommodate instruments of this industry standard. It would thus be desirable for a tailpiece tuning mechanism to be sufficiently compact for effective use on such standard-dimensioned guitars without requiring custom sized cases.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein; this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

The present invention provides a tuning mechanism that may be fitted to a variety of stringed instruments and as such, the present invention is not limited to use with any particular instrument type. Although the invention is described here with respect to use with bass guitars, it should not be seen as limiting but for exemplary purposes only.

According to a first aspect, the present invention provides a tuning mechanism for a stringed instrument, the stringed instrument including:

- a body;
- a substantially elongate neck extending from the body;
- a plurality of elongate strings, each string secured to a distal end of the neck (herein referred to as a 'headstock') by a headstock string retainer and to the body by a body string retainer, (a plurality of body string retainers herein referred to as a 'tailpiece'), said strings being tensioned over a span formed between,
- a first and a second string supports, respectively located on the body and at, or adjacent, said headstock;

wherein said tuning mechanism includes:

- a manually adjustable tensioning mechanism, locatable on the body and connected to,
- at least one movable string deflector, contacting a string between said first string support and the tailpiece along a deflection path co-incident with the longitudinal axis of the string between said first string support and the tailpiece, and characterised in that;

for each string, manual adjustment of the tensioning mechanism produces a commensurate movement of the string deflector generating lateral deflection of the string along the deflection path from contact with the string deflector.

Preferably, the tuning mechanism includes a string deflector guide surface, wherein said commensurate movement of the string deflector is at least partially along the string deflector guide surface.

Although it is well understood that stringed instruments such as bass guitars may be used in a variety of orientations, to aid clarity, understanding and conceptualisation, said string instrument is herein defined such that the 'upper' side or surface corresponds to the side of the instrument fitted with the playing strings.

Laterally deflecting the strings yields two advantages for string tuning, namely;

- varying the string tension by a given amount requires less instantaneous force than that required to apply tension linearly along the string's longitudinal axis. The reduced force requirement translates into easier manual adjustability for the user, and
- a more compact tuning mechanism due to the reduced linear movement required co-axially, or parallel with the string to increase the string tension by the same amount as a conventional axial tensioner.

These advantages provide the opportunity to produce a bass guitar with handling and tuning performance benefits.

Ideally, the tuning mechanism should be located in a position on the bass guitar that biases the tailpiece downwards and the headstock upwards whilst still fitting within the dimensions of a standard bass guitar and should provide accurate, stable, easily adjustable string tension. The aforesaid advantages of the present invention assist in each of these desirable handling and performance characteristics.

It will be appreciated that if the tuning mechanism increased the string tension by extending the string a distance along its longitudinal axis, this unavoidably adds at least the same distance to the minimum length of the tuning mechanism with respect to the same longitudinal axis. In contrast, tensioning the string by deflecting it laterally provides the ability to reduce the length of the tuning mechanism otherwise required in the same direction as the string's longitudinal axis. Moreover, as a greater lateral movement of the string is required to shorten the string by a given amount than by a longitudinal movement of the same given amount, it follows less force is required to deflect the string given the greater distance travelled. This translates into a reduced input force required by the user to vary the string tension.

It will also be readily understood that the advance of requiring a reduced user input force to vary the string tension is also beneficial to other, non-bass guitars. Also advantageous to all guitar types is the ability to provide said tuning without subjecting the guitar string to undue abrasion, stress, or an otherwise detrimental effect.

Preferably, each string is orientationally realigned about said first string support such that each string's longitudinal axis between the tailpiece and the first string support and between the first and second string supports are non-coaxial and non-parallel, In one embodiment, the string deflector guide surface is rigidly connected to the tensioning mechanism by a base support surface mounted on, and substantially parallel with, an upper surface of the body. In an alternative embodiment, the base support surface is at least partially separated from the string deflector guide surface and/or the tensioning mechanism. It will be readily appreciated that provided the necessary spatial interrelationship exists between the string deflector guide surface, the base support surface and tensioning mechanism, it is not essential that they be directly connected to each other or formed as a single continuous structure.

According to a further aspect, said string deflector guide surface is formed as a ramp, inclined downwards toward the surface of the body in a direction facing towards the headstock. It is axiomatic that inclining the string deflector guide surface in the opposite direction would be counterproductive to achieving the above-stated advantages of the present invention.

Preferably, said movable string deflector includes;

a first roller bearing providing rolling contact between the string deflector and the string deflector guide surface, a second roller bearing providing rolling contact between the string deflector and the string between the first string support and the tailpiece along said deflection path, said first and second roller bearings mutually contra-rotating in use as the string deflector moves along the string deflector guide surface.

In one embodiment said string deflector includes said first and second roller bearings; wherein, said string deflector guide surface and the deflection path are collinear and said first and second roller bearings each have an axis of rotation in a common plane substantially parallel with the string deflector guide surface.

In an alternative embodiment said string deflector includes said first and second roller bearings; wherein said string deflector guide surface and the deflection path are non-collinear and said first and second roller bearings each have an axis of rotation in a common plane, substantially non-parallel with the string deflector guide surface.

According to a further embodiment, the first and second roller bearing's axes of rotation are coaxial. The first roller bearing may be formed as two separate bearings with the second roller bearing interleaved between, all rotating about a common axis. Alternatively, the first and second roller bearings may be positioned adjacently on a common rotation axis. In a yet further embodiment, the second roller bearing may be formed as an annular groove in the outer surface of said first roller bearing. Alternatively, either or both of said first and second roller bearings maybe formed as sliding contact surfaces.

Despite the variety of possible configurations of the first and second roller bearing, each preferably have a common characteristic. Configuring the first and second bearings to be mutually contra-rotatable permits a significant amelioration of the frictional and abrasive force which would otherwise be applied between the string deflector and the string deflector guide surface and/or the string by movement of the string deflector.

Contra rotation is preferably provided by both the first and second bearing being freely rotatably in mutually opposing directions. However, it will be appreciated that mutual contra rotation still results even if the rotation of one of the bearings is partially retarded or even fixed. As used herein, contra rotation includes counter rotation, rotation about parallel axes and co-axial rotation of said first and second bearings. As the string deflector moves along the string deflector guide surface, rolling on the first bearing, the second bearing rotates in the opposite direction in contact with the string, thereby avoiding any dragging, scraping, or detrimental friction. If the second bearing was omitted and the string placed directly in contact with the upper surface of the first bearing, either the first bearing would cease rotating along the string deflector guide surface or it would scape against the string.

It will be appreciated that the deflection path may be linear, arcuate, irregular, or a composite of same according to the configuration of the tuning mechanism. Examples of factors affecting the configuration of the deflection path include;

the relative angle between the string deflector guide surface, the upper body surface and/or the upper base support surface;

the shape of the string deflector guide surface, e.g. linear, concave, convex, asymmetrically curved and so forth.

In an alternative embodiment, the deflection path may be provided by an outer surface of a rotatable cam contacting the string, said cam having a variable radius about an axis of rotation such that for each string, manual adjustment of the tensioning mechanism produces a rotational movement of said cam surface and thereby a change in the radius of the cam surface in contact with the string and a commensurate change in string deflection.

Self-evidently, it is desirable to minimize the friction between the moving parts of the tuning mechanism under load. Roller bearings provide such a means of friction reduction between the moving parts of the string deflector and the string, string deflector guide surface and/or the base support surface. However, provided the resultant frictional loads caused by the specific configuration of string tension, bass guitar configuration and tensioning mechanism is satisfactorily operable by the user, alternative sliding contacts may replace one or more of the roller bearings.

As used herein, the term roller bearing includes any form of rotatable roller, bearing, wheel, spindle, axle, shaft or other rotation means.

Preferably, according to one embodiment said string deflector further includes a third roller bearing providing rolling contact between the string deflector and the base support surface.

According to an alternative embodiment, said string deflector further includes a sliding contact surface providing sliding contact between the string deflector and the base support surface.

Preferably, the base support surface provides an upper surface for rolling and/or sliding contact with said string deflector, said upper base support surface forming a plane parallel to said tension adjustment axis and intersecting the string deflector guide surface at an obtuse interior angle.

While the use of roller bearings provide reduced frictional drag to movement, it will be appreciated that alternative configurations of are possible including the use of sliding contact surfaces, particularly using low friction materials at least partially or wholly replacing said roller bearings.

According to a yet further embodiment, said tensioning mechanism is connected to the string deflector via said screw threaded connection to an internally threaded sleeve, pivotally attached to said carriage about a sleeve pivot axis substantially orthogonal to the axis of said screw threaded connection.

The use of said first, and/or third roller bearings, and/or said pivotable sleeve in the string deflector carriage allows the orientation of the carriage to change while the carriage remains in contact with both of the non-parallel base support surface and the string deflector guide surface during movement of the carriage.

Thus, when a user operates the tuning mechanism by adjusting the tensioning mechanism, at least part of the carriage moves linearly along, or parallel to, the;

tension adjustment axis;

deflection path, and/or deflector guide surface.

It will be appreciated that the resultant direction of movement of any given part of the string deflector is dependent on the angular relationship between the base support surface and the string deflector guide surface. The angular relationship provides a balance between compaction of the tuning mechanism and ease of operation.

When considering the angular configuration where the base support surface and the string deflector guide surface are coplanar or parallel, it will be apparent the whole of the string deflector would move in the same linear direction. However, given the requirement for the deflection path to be co-incident with the longitudinal axis of the string between said first string support and the tailpiece, the tuning mechanism is orientated further away from the instrument body. This may be utilised in alternative embodiments to offer different playability, tuning adjustment and aesthetic options.

Preferably, said manually adjustable tensioning mechanism is configured with a fixed fitting attached to the body, said fitting including, for each string, a tensioner in the form of manually rotatable control with a screw threaded connection to a corresponding string deflector.

Preferably, adjustment of a tensioner by rotation of the screw threaded connection to a string deflector causes at least part of the string deflector to move linearly along a tension adjustment axis. In one embodiment, the tension adjustment axis is substantially parallel to the base support surface and/or the upper surface of the body.

According to one aspect, the tension adjustment axis is substantially parallel to the longitudinal string axis of the strings spanning said first and second string supports.

In one embodiment, said tension adjustment axis forms an angle of between 2-10° with the longitudinal string axis of the strings spanning said first and second string supports Preferably, said tension adjustment axis forms an angle of between 3-7° with the longitudinal string axis of the strings spanning said first and second string supports Preferably, said tensioning mechanism fitting is configured as a rigid housing, apertured with individual threaded passageways to accept a corresponding rotatable screw threaded tuning control for each string. Preferably, a said rotatable tuning control is mounted on at least one axial bearing. It will be appreciated that when the movable string deflector travels along an inclined string deflector guide surface during tuning, the string tension applies a downward force component on the string deflector, which in turn applies a force laterally to said tension adjustment axis. This creates a torsional force on the rotatable tuning control axial bearings. This may be resisted by utilising twin axial bearings on either side of each threaded passageway through the rigid housing. Thus, each said rotatable tuning control is mounted on a pair of axial bearings.

Preferably, the movable string deflector is formed as a carriage.

It will also be appreciated that varying the string tension by deflecting the string laterally between the first string support and the tailpiece may be accomplished by a deflection on any side of the string. Given the restricted space between adjacent strings on a typical instrument, it is impractical to fit a deflecting mechanism between the strings for lateral deflection in the plane of the strings. Consequently, only 'pulling' or 'pushing' the string towards, or away from the tailpiece remain as feasible alternatives. Whilst the prior art tuning mechanisms focus on pulling the guitar string to increase tension, the present invention is not restricted to same.

According to one embodiment the tailpiece may include at least one string retainer formed from at least one of;

an aperture or recess in or through the body; and/or an aperture or recess in or through the base support surface, with a constriction, neck, restriction, cleft, narrowing passageway, taper, frusto-conical, or cavity portion or the like, capable of retaining an end of a string, including a string with a ball-end fitting. It will be appreciated that the tailpiece string retainer may be formed directly as part of the body, as part of the base support surface, as a separate element and/or any combination of same. Typically, a tailpiece for a bass guitar would include at least four and sometimes five or six string retainers, corresponding to the number of strings fitted.

According to one alternative embodiment, said tailpiece string retainer is incorporated as part of the tuning mechanism, thereby providing a means for retaining the end of each string to the body. According to further embodiment, a retainer may protrude above the base support surface to provide a travel stop for the string deflector.

Guitars and bass guitars may be generally classified into four types, namely:

Acoustic Guitars—formed from thin wooden sheets enclosing a large void, with a sound hole usually below the strings. Acoustic guitars are sufficiently loud to play to small audiences unamplified.

Electric-acoustic—similar in construction to an acoustic guitar with the addition of a transducer (attached to the bridge or the underside of the soundboard) to convert the sound to an electrical signal for amplification. Electric-Acoustic guitars can be played both unplugged or amplified.

Solid body electric—a guitar with a solid body (typically wood), without any functionally resonating air spaces. Consequently, amplification is required to produce sound of any significance. The sound is transmitted and amplified from signals induced in electromagnetic inductors (termed 'pickups') by the movement of the strings over the inductors' magnetic cores.

Semi-acoustic (or 'hollow-body' electric)—an electric guitar with a hybrid acoustic construction in which at least some part of the body includes a hollow void and a solid piece that extends the length of the guitar's body from the tail end to the neck mount. The hollow body portion is insufficiently sized to provide satisfactory volume or tone without amplification. Electromagnetic pickups of the type used in solid body electric guitars are used to transmit the sound signal of amplification. The purpose of the hollow section of the body is primarily for influencing the character of the guitar's tone.

The inherent structural characteristics of the above guitar types affects their suitability for different types of fittings. In the case of electric bass guitars for example, the high string tension levels requires greater robustness for each string retainer than acoustic guitars. Due to the efficacy in providing a reduction in the required user force to vary string tension, it follows that solid body electric guitars and semi-acoustic guitars are particularly suitable instruments for incorporation of the present invention. The solid body of these guitar types enables the use of more robust string retainers to withstand higher string tensions. Thus, according to a further embodiment of the present invention, a portion of said stringed instrument body is substantially solid beneath said strings between said instruments upper surface and a substantially opposing lower body surface.

Preferably, said stringed instrument is a solid body electric or semi-acoustic electric guitar.

A further consequence of the present invention's suitability to provide easy manual tuning adjustment of high tension strings is its use in bass guitars and/or instruments which require robustly-mounted tailpiece string retainers. It follows that guitars or other instruments that incorporate user-operable vibrato systems (also known as a whammy, vibrato, or tremolo arm/bar systems) are inherently more difficult to use with higher tension strings. Such vibrato systems require the incorporation of an integrated bridge, a support base and string tailpiece retainer which all pivot together to achieve the vibrato effects. Such configurations create challenges in maintaining the string tension and tune and are inherently less robust than a fixed tuning system.

Thus, according to one embodiment of the present invention, said tuning system is rigidly attached to said instrument body. Preferably, said tuning system is non-pivotable about said body upper surface.

As a further means of enhancing the robustness of the tuning mechanism and its suitability for high tension strings, the base support surface and/or the string deflector guide surface are rigidly attached to, or formed by the upper surface of the body.

According to a further embodiment, the tuning mechanism further includes a headstock string retainer. Preferably, said headstock string retainer includes a secondary string tension adjustment means such as a tapered, friction-fit peg, releasably securable to a corresponding aperture in the headstock. Coarse tuning adjustment may be achieved by winding the string around the peg to a close approximation of the tension necessary to achieve the correct pitch before engaging the peg firmly within its headstock aperture. Once the peg is firmly fixed in its aperture, the string is effectively fixed at the headstock, and fine tuning may thus be undertaken at the tailpiece tuning mechanism to fine tune each string.

The headstock string retainer may be formed from any convenient configuration including, clamps, geared pegs, friction pegs, and the like. The alternative types of headstock string retainers may be subdivided into retainers that simply secure the end of the string to the instrument and those that also provide a means to vary the string tension. The string tension may be accomplished in a variety of methods such as simply winding the string around a friction-fit peg, or using geared tuners or geared pegs.

In a further embodiment, said first string support (also known as the bridge) is incorporated as part of the tuning mechanism.

It should thus be understood that the tuning mechanism is not limited to a configuration with its constituent components formed as a single unified structure and that parts of the tuner may be configured as discrete components or elements without departing from the scope of the invention. Moreover the term tuning mechanism is not to be interpreted in a restrictive or exclusive sense.

According to a further aspect of the present invention, the base support surface is formed directly by an upper surface of the body. According to a yet further aspect, the string deflector guide surface is also formed directly by an upper surface of the body. The tuning mechanism may therefore be formed as a discrete unit for attachment to a stringed instrument or be partly, or wholly, formed as an integral part of the instrument.

Thus, according to a further aspect, the present invention provides a musical instrument as hereinbefore described including a tuning mechanism substantially as hereinbefore described.

According to one aspect, the present invention provides a musical instrument including:

- a tuning mechanism substantially as hereinbefore described;
- a body;
- a substantially elongate neck extending from the body;
- a plurality of elongate strings, secured to a distal end of the neck (referred to as a 'headstock') by a headstock string retainer and to the body by a body string retainer (a plurality of body string retainers referred to as a 'tailpiece'), said strings being tensioned over a span formed between,
- a first and second string support, respectively located on the body and at, or adjacent, said headstock;

each string being orientationally realigned about said first string support such that each string's longitudinal axis between the tailpiece and the first string support and between the first and second string supports are non-coaxial and non-parallel, wherein said tuning mechanism includes:

- a manually adjustable tensioning mechanism, located on the body and connected to,
- at least one movable string deflector, contacting a string between said first string support and the tailpiece along a deflection path co-incident with the longitudinal axis of the string between said first string support and the tailpiece;

characterised in that;

for each string, manual adjustment of the tensioning mechanism produces a commensurate movement of the string deflector generating lateral deflection of the string along the deflection path from contact with the string deflector.

Thus, it will be further apparent to one skilled in the art that the tuning mechanism may be configured with any combination or permutation of the string deflector guide surface, tailpiece, tensioning mechanism, base support surface and/or first string support being formed as an integral unit or as discrete, individual components and/or formed directly as part of the instrument body.

BRIEF DESCRIPTION OF DRAWINGS

Further aspects and advantages of the present invention will become apparent from the following description which is given by way of example only and with reference to the accompanying drawings in which.

BEST MODES FOR CARRYING OUT THE INVENTION

REFERENCE NUMERALS FOR FIGS. 1-17

Figure 1:
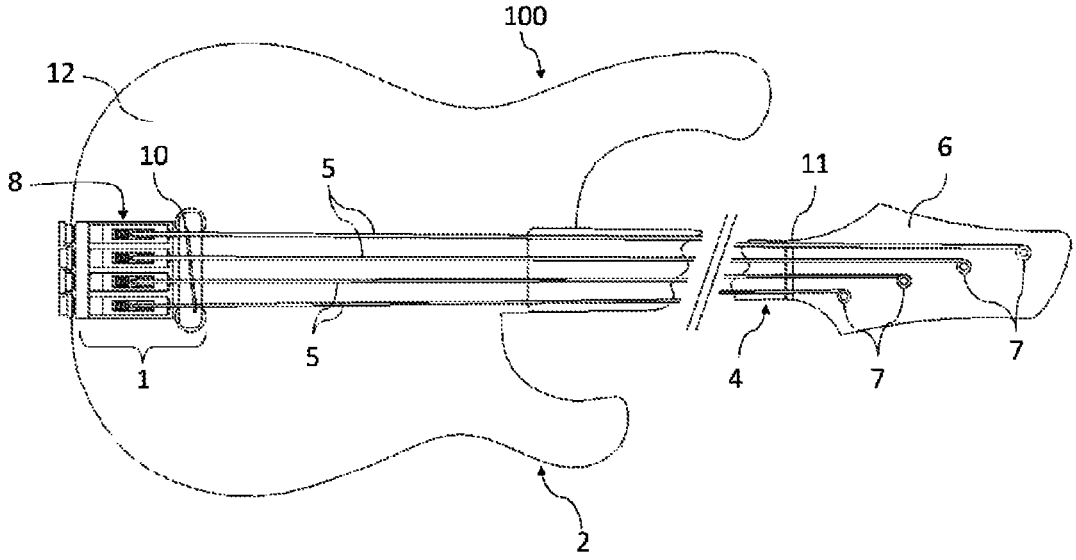
FIG. 1. shows a plan view of a first preferred embodiment of the present invention in the form of a tuning mechanism fitted to a bass guitar and in the form of a stringed instrument including a tuning mechanism.

(1)-fine tuning mechanism
(2)-bass guitar
(3)-body
(4)-neck
(5)-string
(6)-headstock
(7)-tuning peg -continued (8)-tailpiece
(9)-retainer
(10)-bridge
(11)-nut
(12)-upper body surface
(13)-tensioning mechanism
(14)-string deflector
(15)-string deflector guide surface
(16)-housing
(17)-apertures
(18)-tuning control
(19)-tuning control bearings
(20)-threaded shaft
(21)-knob
(22)-flange
(23)-carriage
(24)-sleeve
(25)-support bushing
(26)-base support surface
(27)-ramp roller bearing
(28)-string deflector roller bearing
(29)-deflection path
(30)-tension adjustment axis
(31)-ramp roller adjustment axis
(32)-connecting shaft
(33)-cam lever
(34)-string ball end
(35)-base support surface apertures
(36)-lower body surface
(100)-string instrument with fine tuning mechanism Aspects of the present invention have been described by way of example only and it should be appreciated that modifications and additions may be made thereto without departing from the scope thereof.

FIGS. 1-8 show a tuning mechanism according to one embodiment of the present invention in the form of a bass guitar fine tuning mechanism (1).

The tuning mechanism of the present invention is applicable to a wide range of musical instruments and although described herein with respect to a bass guitar (2), it should not be construed as being limited to same. However, the advantages of the present invention, including a compact tuner (1) and a reduction in the finger force require to adjust the higher tension strings used in bass guitars naturally promotes the use of the invention with such instruments.

Figure 2:
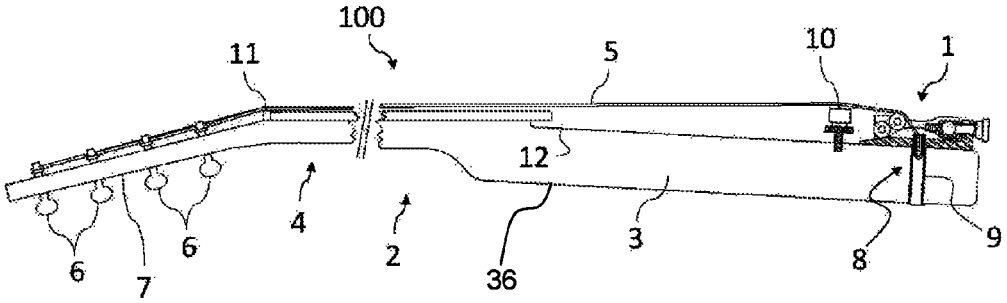
FIG. 2. shows a side elevation of the bass guitar of FIG. 1.

In one embodiment, the present invention provides a tuning mechanism (1) for use with a stringed instrument such as a bass guitar (2) (as shown in FIGS. 1 and 2), including a guitar body (3), a substantially elongate neck (4) extending from the body (3). Four elongate strings (5) are secured to the headstock (6) at a distal end of the neck by a headstock string retainer provided in the form of tuning pegs (7). The strings (5) are secured to the body (3) at the opposite end by a tailpiece (8) composed of individual body string retainers (9) for each string (5). The strings (5) are tensioned across a span formed between first and second string supports respectively provided in the form of a bridge (10) located on the body (3) and a nut (11) located at, or adjacent, the headstock (6). The strings (5) between the bridge (10) and nut (11) extend substantially parallel to and are spaced-apart from the upper surface (12) of the body (3) and the neck (4). After passing over the bridge (10) from the nut (11), the strings (5) are realigned to incline downwards towards the body (3) to be secured at their respective retainers (9) which pass through the body (3) in the tailpiece (8) from the upper body surface (12) to an opposing underside (36).

Typically in musical instruments such as the bass guitar (2) shown in FIGS. 1 and 2, each string (5) is orientationally realigned as it passes over the bridge (10) and is angled towards the guitar body (3). Thus, each string's longitudinal axis between the tailpiece (8) and the bridge (10) and between the bridge (10) and the nut (11) are non-coaxial and non-parallel.

Figure 3:
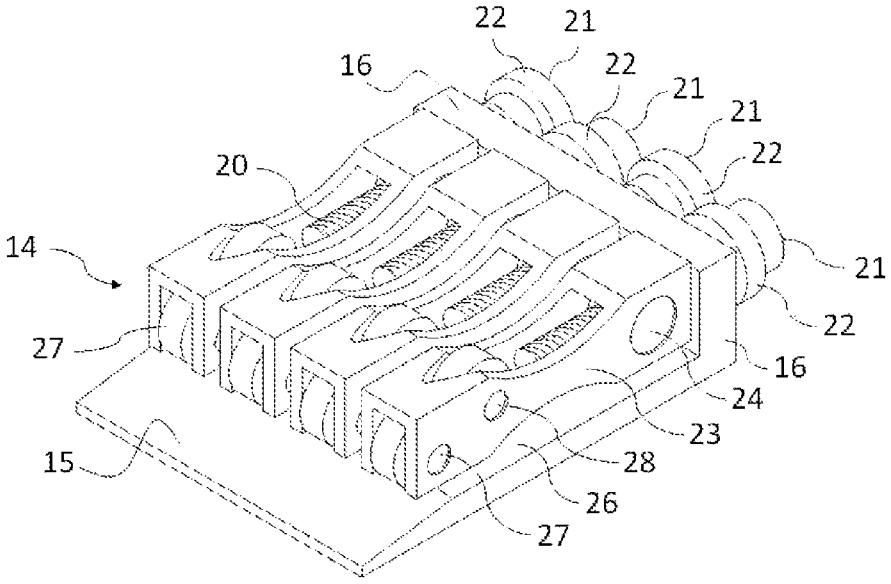
FIG. 3. shows an isometric view of the tuning mechanism of FIG. 1.
Figure 4:
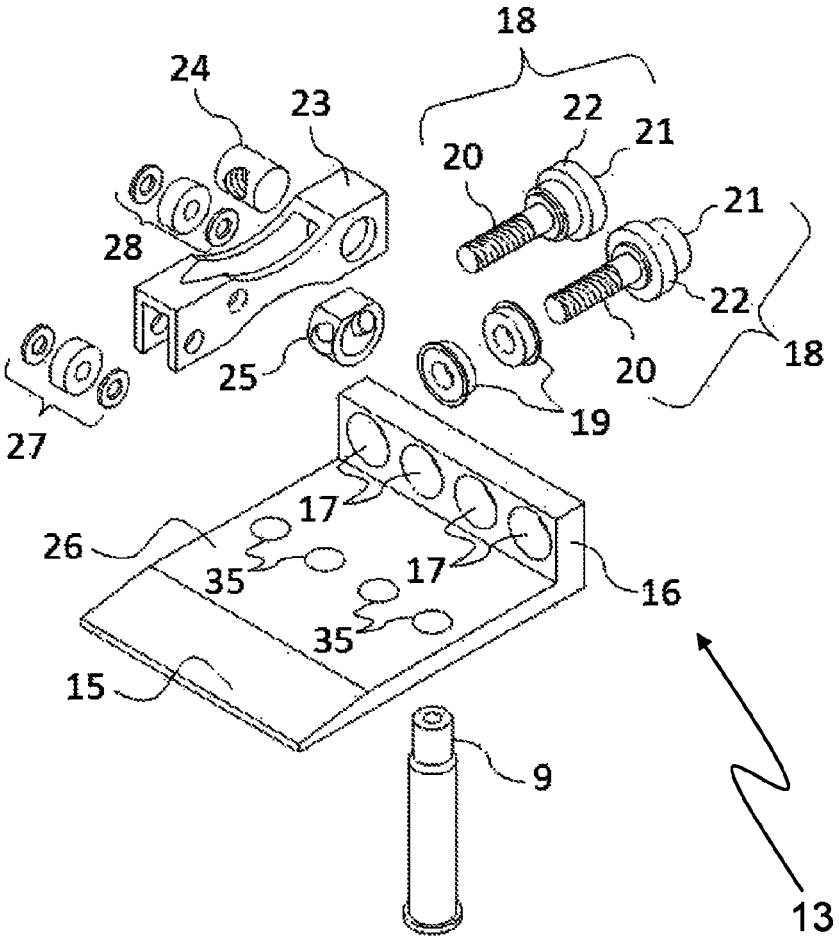
FIG. 4. shows an exploded view of the tuning mechanism of FIG. 2.

The tuning mechanism (1) is shown in great detail in FIGS. 3-6 and includes:

a manually adjustable tensioning mechanism (13);

a movable string deflector (14) for each string (5), and a string deflector guide surface (15);

In the embodiment shown in FIGS. 3 and 4, the tensioning mechanism (13) is formed of a rigid housing (16) with apertures (17) to provide individual passageways for a rotatable, screw-threaded tuning control (18) for each of the strings (5). The threaded tuning controls (18) are each rotationally mounted on a pair of axial bearings (19) positioned at the opposing openings of each aperture (17).

Each threaded tuning control (18) is composed of an elongate shaft (20), threaded at one distal end with a radially enlarged knob (21) at the other opposing distal end. To maximise ease-of-use, adjacent knobs (21) are configured with an enlarged diameter flange portion (22) to increase the rotational torque applied by the user during tuning. The flanges (22) on adjacent knobs (21) are offset with respect to the longitudinal axis of the shaft (20) to allow the knobs to be located in closer proximity without mutual interference.

The tuning controls (18) are rotated by the user in order to vary the position of the string deflectors (14) which are each comprised of several components retained together by a carriage (23).

The threaded shaft (20) of each tuning control (18) is coupled to the carriage (23) via an internally threaded sleeve (24) which is itself pivotable within a support bushing (25) about a sleeve pivot axis orthogonal to the axis of the internal screw thread. The exterior surface of the support bushing (25) provides a sliding contact surface between the string deflector (14) and the base support surface (26) while the inner surface of the bushing (25) allows the sleeve (24) to rotate freely about the sleeve pivot axis. The support bushing (25) also ensures a stable transverse alignment between the carriage (23) and the threaded shaft (20).

Also retained by the carriage (23) as part of the string deflector (14) are first and second roller bearings. The first roller is provided in the form of ramp bearing (27) and provides rolling contact between the string deflector (14) and the string deflector guide surface (15). The second roller bearing is provided in the form of string deflector bearing (28) and provides rolling contact between the string deflector (14) and the string (5) between the bridge (10) and the tailpiece (8).

In the embodiment shown in FIGS. 1-8, the string deflector guide surface (15), tensioning mechanism housing (16) and base support surface (26) are all formed as part of a single rigid component attached to the upper surface (12) of the guitar body (3). Alternative configurations are discussed subsequently in greater detail.

Figure 5A:
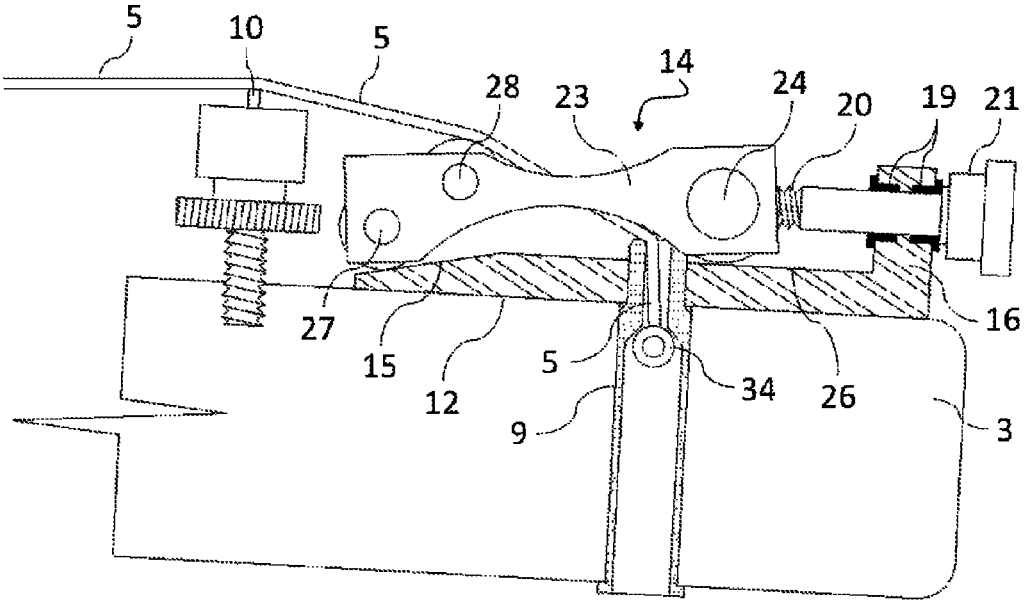
FIG. 5*a*. shows a partial section side elevation of the tuning mechanism of FIG. 1 with the string deflector fully extended.
Figure 5B:
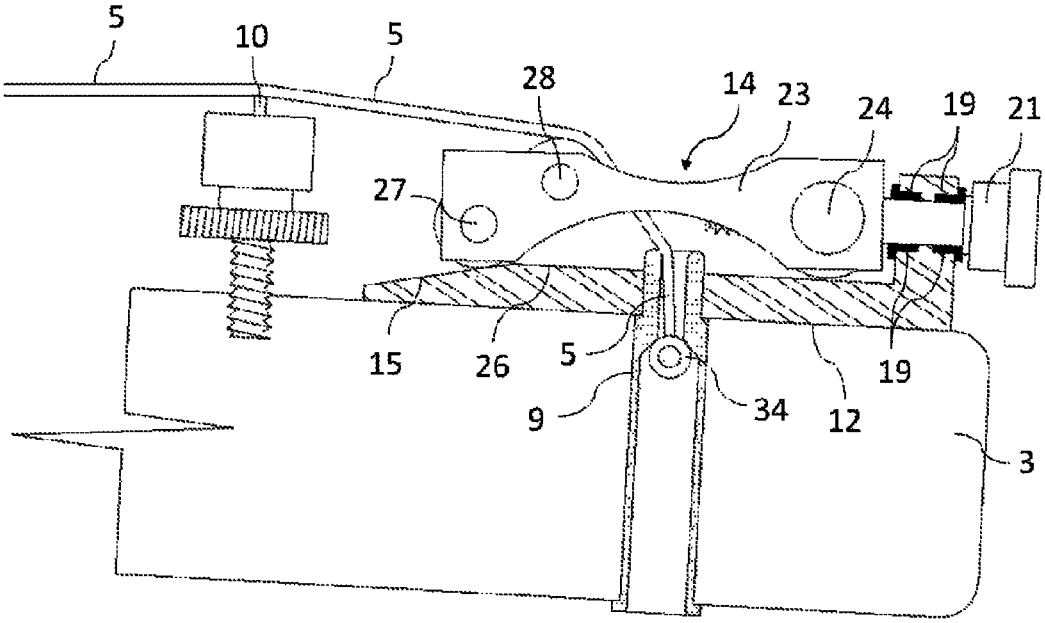
FIG. 5*b*. shows a partial section side elevation of the tuning mechanism of FIG. 5*a* with the string deflector fully retracted.
Figure 6:
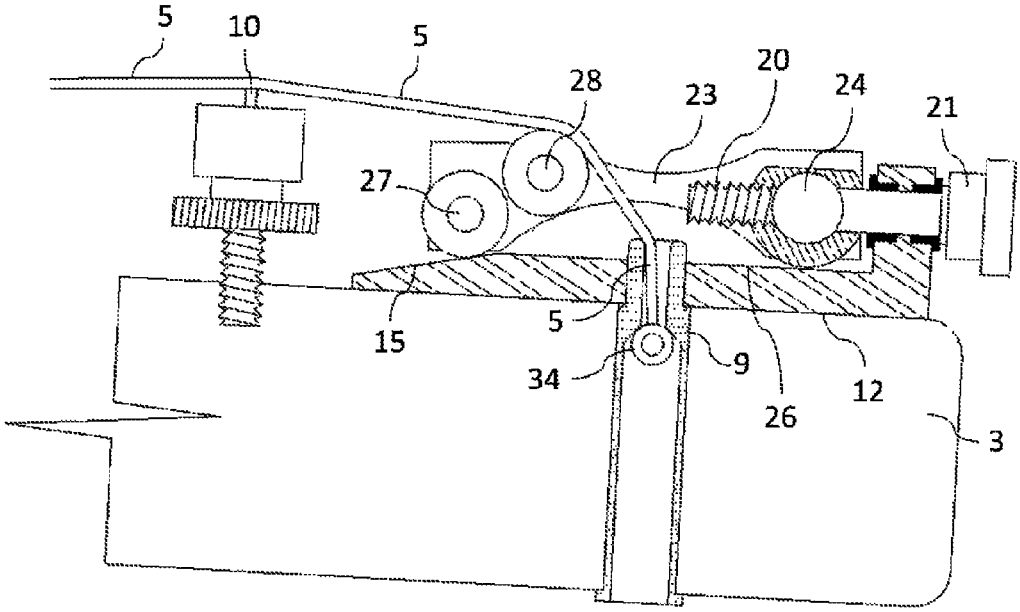
FIG. 6. shows a section side elevation of the tuning mechanism of FIG. 5 with the string deflector fully retracted.

FIGS. 5*a* and 5*b* respectively show the tuning mechanism (1) with a string deflector (14) positioned at the extremities of its range of movement which thereby apply a correspondingly lesser and greater degree of tension to the string (5). To adjust the tension on a string (5) using the tuning mechanism (1), the user rotates the knob (21) which in turn rotates the threaded shaft (20) within the sleeve (24) of the carriage (23). Depending on the direction of rotation of the knob (21), the carriage (23) is either pulled towards, or pushed away from the tuning control housing (16).

The path of the string (5) between the bridge and the retainer (9) passes between the string deflector bearing (28) and the sleeve/support bushing (24, 25). When the carriage (23) is pulled towards the housing (16) the string deflector bearing (28) applies increasing pressure on the string (5). As the carriage (23) moves towards the housing (16), the sleeve/support bushing (24, 25) slides linearly along the upper base support surface (26), along a substantially parallel axis to the upper body surface (12). The contact between the sleeve/support bushing (24, 25) and upper base support surface (26) supports the carriage (23) and tuning control (18) under the downward pressure of the string (5) tension. It will be appreciated that the separation along the tension adjustment axis (31) of the two of tuning control bearings (19) on either side of the housing (16) also provides resistance to the downward string (5) pressure on the tuning control (18).

The ramp bearing (27) is positioned on the inclined string deflector guide surface (15) and moves linearly up the inclined surface (15) as the carriage (23) is retracted towards the housing (16). The string deflector bearing (28) is mounted within the carriage (23) with sufficient clearance from the string deflector guide surface (15) and/or the upper support base surface (26) to avoid contact with same during movement of the carriage (23) between the extents of its travel range. This configuration ensures that the string deflector bearing (28) is able to rotate freely against the string (5) as the tension on the string (5) is varied by moving the carriage (23), thereby greatly reducing the frictional resistance exerted on the movement of the carriage (23).

The path followed by the string deflector bearing (28) up the inclined string deflector guide surface (15) during retraction of the carriage (23) between the position of maximum carriage (23) extension (shown in FIG. 5*a*) and minimum carriage (23) extension (shown in FIG. 5*b*) is a deflection path (29) co-incident with the longitudinal axis of the string between the bridge and the tailpiece (8). In the embodiment shown in FIGS. 1-8, the deflection path ( ) is a linear axis, though it will be appreciated that in alternative embodiments, the deflection path (29) may be arcuate, irregular, or a composite of same.

Figure 7:
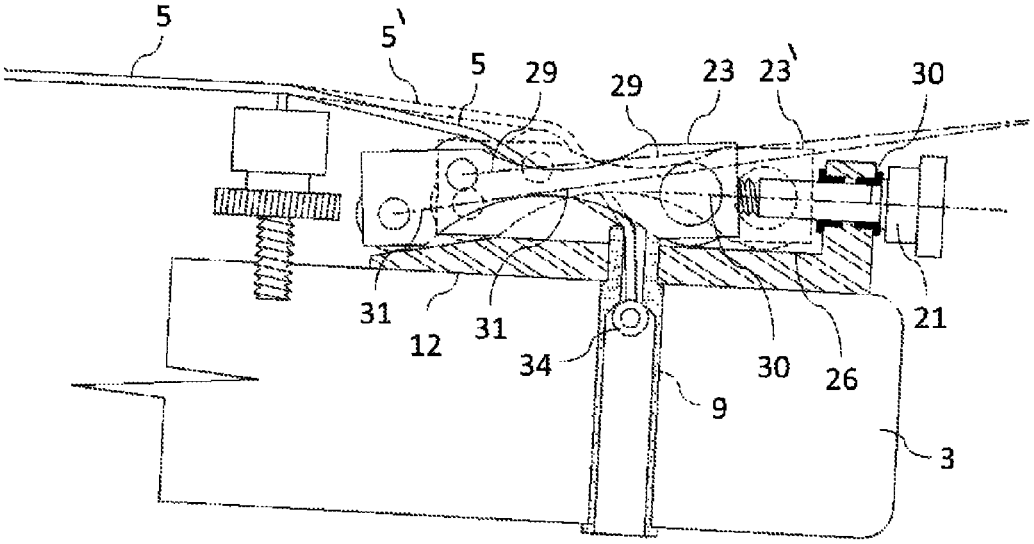
FIG. 7. shows a section side elevation of the tuning mechanism of FIG. 6 with the string deflector fully extended together with the position of the string deflector and string in the fully retracted position shown in phantom.

In use manual adjustment of the tensioning mechanism (13) via the tuning controls (18) produces a corresponding movement of the string deflector (14) along a tension adjustment axis (30) parallel to the string deflector guide surface (15). Movement along the tension adjustment axis (30) by the string deflector (14), generates a lateral deflection of the string (5) (denoted in phantom by the deflected string (5') position and relocated carriage (23')) along the deflection path (29) from contact with the string deflector roller bearing (28), as shown in FIG. 7. During movement of the string deflector (14), the rotation axis of the ramp roller bearing (27), moves parallel to the string deflector guide surface (15) along the ramp roller adjustment axis (31).

Thus, to tune each string (5), rotation of the tuning control (18) by the user displaces the string deflector (14) in either a direction;

towards the guitar headstock (6) and down the string deflector guide surface (15) thereby releasing tension on the string (5) and lowering the tuned pitch or away from the guitar headstock (6) and up the string deflector guide surface (15) thereby increasing tension on the string (5) and raising the tuned pitch of the string.

It can be seen in FIG. 7 that the ramp roller adjustment axis (31) and the deflection path (29) are not actually parallel. This is due to the articulation of the carriage (23) as the two contact points (i.e. the ramp roller bearing (27) and the support bushing (25)) of the string deflector (14) with the bass guitar body (3) (via the string deflector guide surface (15) and base support surface (26) respectively) are also not parallel.

The above described configuration of a fine tuning mechanism has some salient advantages in comparison to the conventional tuning mechanisms.

It is desirable for a tailpiece tuner to be compact and to be easy to operate. If, for example, the tuning mechanism is sufficiently compact to fit within the standard dimensions of a conventional guitar or bass without compromising the functionality of the instrument or the tuner, it may be potentially utilised with a vast array of existing instruments rather than requiring an unorthodox custom design.

Similarly, reducing the physical effort required in adjusting the string tension is axiomatically a direct benefit for the usability of the tuning mechanism. It is naturally desirable to provide at least one or preferably both of these advantages in a tuning mechanism.

The embodiment of the present invention shown in FIGS. 1-8 provides both the aforesaid advantages by virtue of laterally deflecting the instrument strings (5) between the tailpiece (8) and the bridge (10).

Figure 8A:
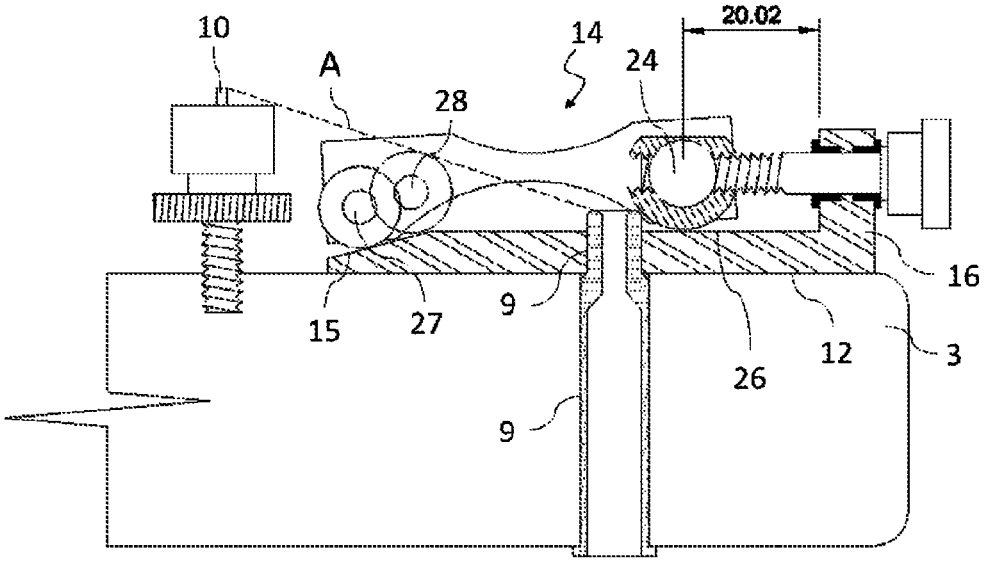
FIG. 8*a* shows a section side elevation of the tuning mechanism of FIG. 6 with the string deflector at a position of zero string deflection.
Figure 8B:
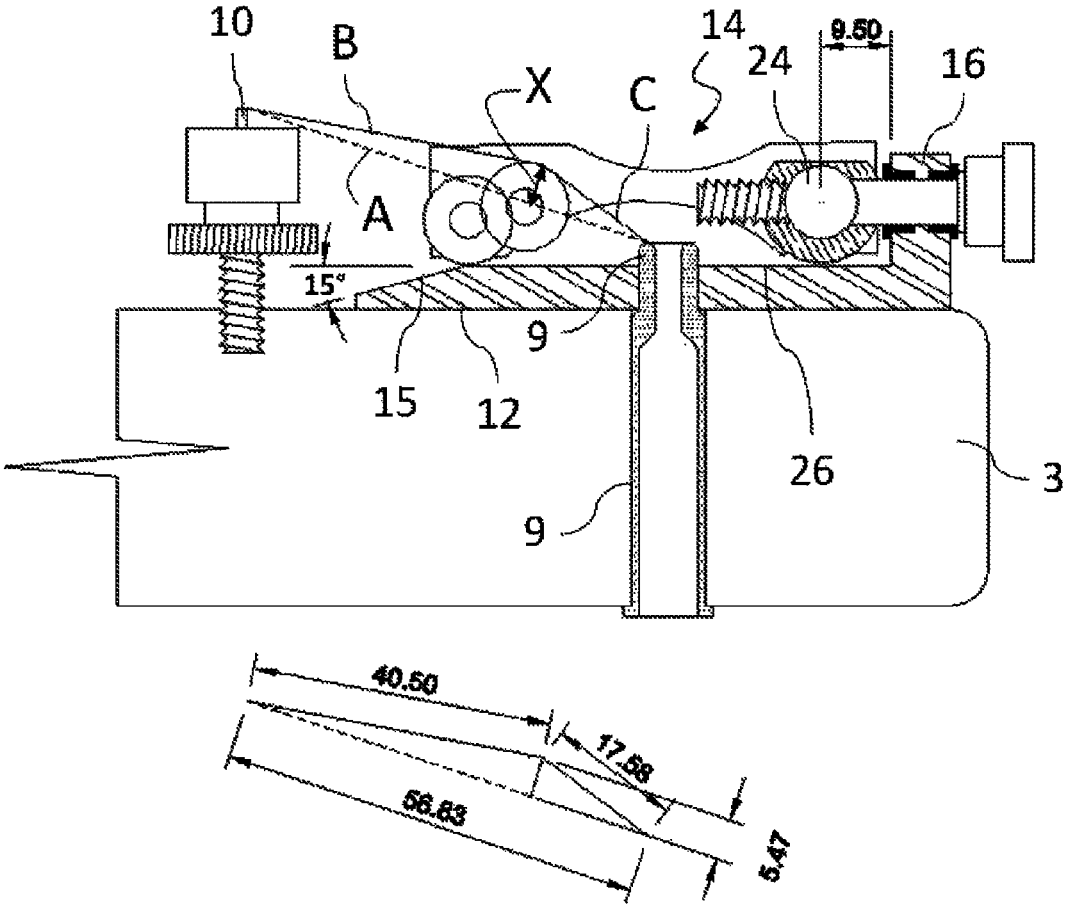
FIG. 8*b* shows a section side elevation of the tuning mechanism of FIG. 6 with the string deflector at a position of maximum string deflection.

FIGS. 8*a* and 8*b* respectively show a fully extended and fully retracted string deflector (14) of the tuning mechanism (1) shown in FIGS. 1-7. The string deflector guide surface (15) is inclined at 15° to the upper surface (12) of the bass body (3) which is also parallel to the base support surface (26).

Figure 8C:
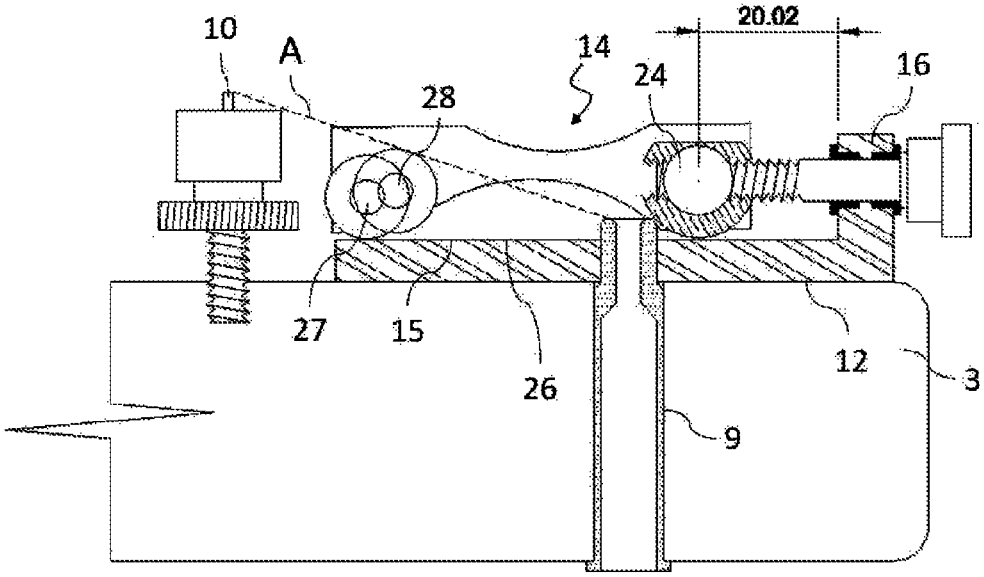
FIG. 8*c* shows a section side elevation of a second embodiment in the form of a tuning mechanism with string deflector guide surface coplanar with the base support surface and parallel with the upper body surface, with the string deflector at a position of zero string deflection.
Figure 8D:
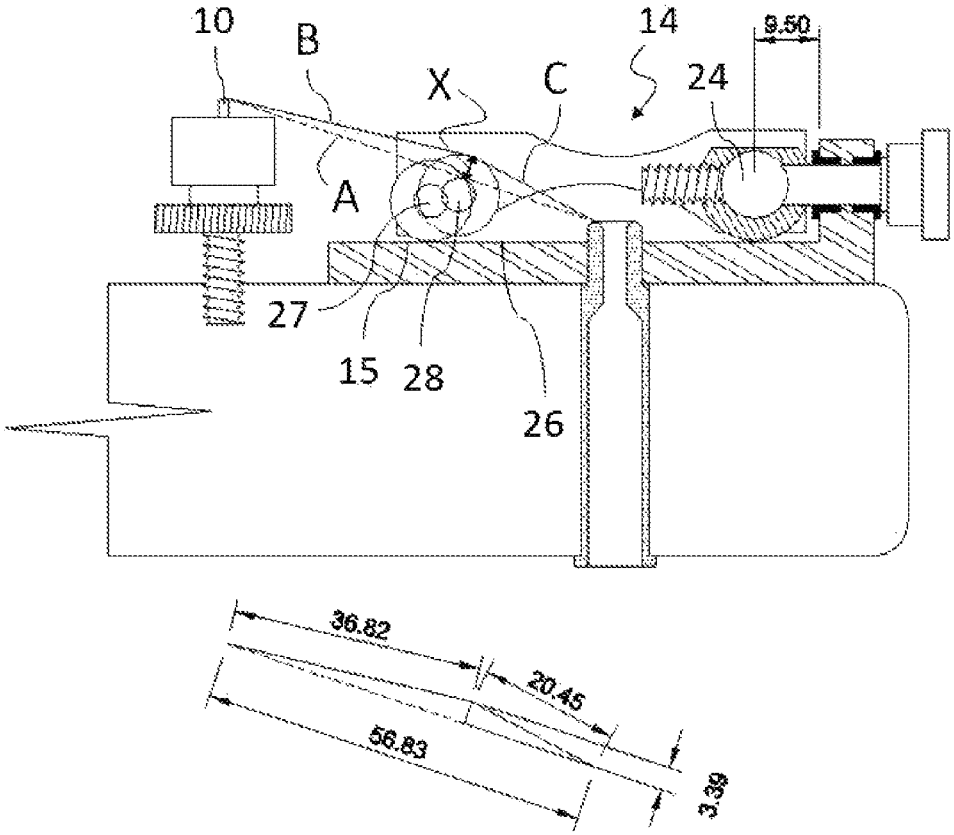
FIG. 8*d* shows a section side elevation of the tuning mechanism of FIG. 8*c* showing the string deflector at a position of maximum string deflection.

FIGS. 8*c* and 8*d* respectively show a tuning mechanism (1) with a fully extended and fully retracted string deflector (14). The tuning mechanism (1) shown in FIGS. 8*a* and 8*b* is identical to that shown in FIGS. 1-7 with the exception that the string deflector guide surface (15) is in the same plane as the base support surface (26). Thus, the deflector guide surface (15) effectively has a 0° inclination.

In order to compare the effects of an inclined deflector guide surface (15) (FIGS. 8*a*, 8*b*) to a zero inclination (FIGS. 8*c*, 8*d*) the string deflectors (14) of both embodiments are shown in a start position (in FIGS. 8*a* and 8*c* respectively) with their ramp roller bearing (27) just touching the string (5) without any lateral deflection. FIGS. 8*b* and 8*d* respectively show the positions of both string deflectors (14) after a displacement D=10.52 mm along the base support surface (26). The displacement D is calculated by the change in separation of the centre of the sleeve (24) from the housing (16), i.e. 20.02−9.50=10.52 mm.

The triangle formed by the string (5) passing between the bridge (10) and the retainer (9) is denoted by the values A, B, C and X where, A=the length of the un-deflected string (5) passing straight from the bridge (10) to the retainer (9);

B=the length of the upper portion of the deflected string (5) between the bridge (10) and the string deflector roller bearing (28);

C=the length of the lower portion of the deflected string (5) between the string deflector roller bearing (28) and the retainer (9), and X=the orthogonal distance between A and the intersection of B and C.

The ABCX triangles (and associated numerical values) formed by the position of the two respective string deflectors (14) after a displacement D=10.52 mm are reproduced immediately below each body (3) in FIGS. 8*b* and 8*d* and in table 1.

TABLE 1

| Embodiment | FIG. 8a, 8b | FIG. 8c, 8d | Δ (absolute) | Δ (%) |
|---|---|---|---|---|
| A | 56.83 | 56.83 | — | — |
| B | 40.50 | 36.82 | — | — |
| C | 17.58 | 20.45 | — | — |
| B + C | 58.08 | 57.27 | 0.81 | 1.4 |
| X | 5.47 | 3.39 | 2.08 | 61.4 |
| D | 10.52 | 10.52 | 0 | 0 |

It can be seen from the numerical values that for the same displacement (D) of the string deflector (14), the configuration with the 15° inclination of the string deflector guide surface (15) produces a 1.4% increase in B+C and over a 60% increase in X compared to the 0° inclination configuration. The increase in B+C is the increase in the length of the string (5) between the retainer (9) and the bridge (10) and corresponds directly with the increase in string tension. The increase in X is a measure of the distance travelled to achieve the increase in string tension.

Figure 8E:
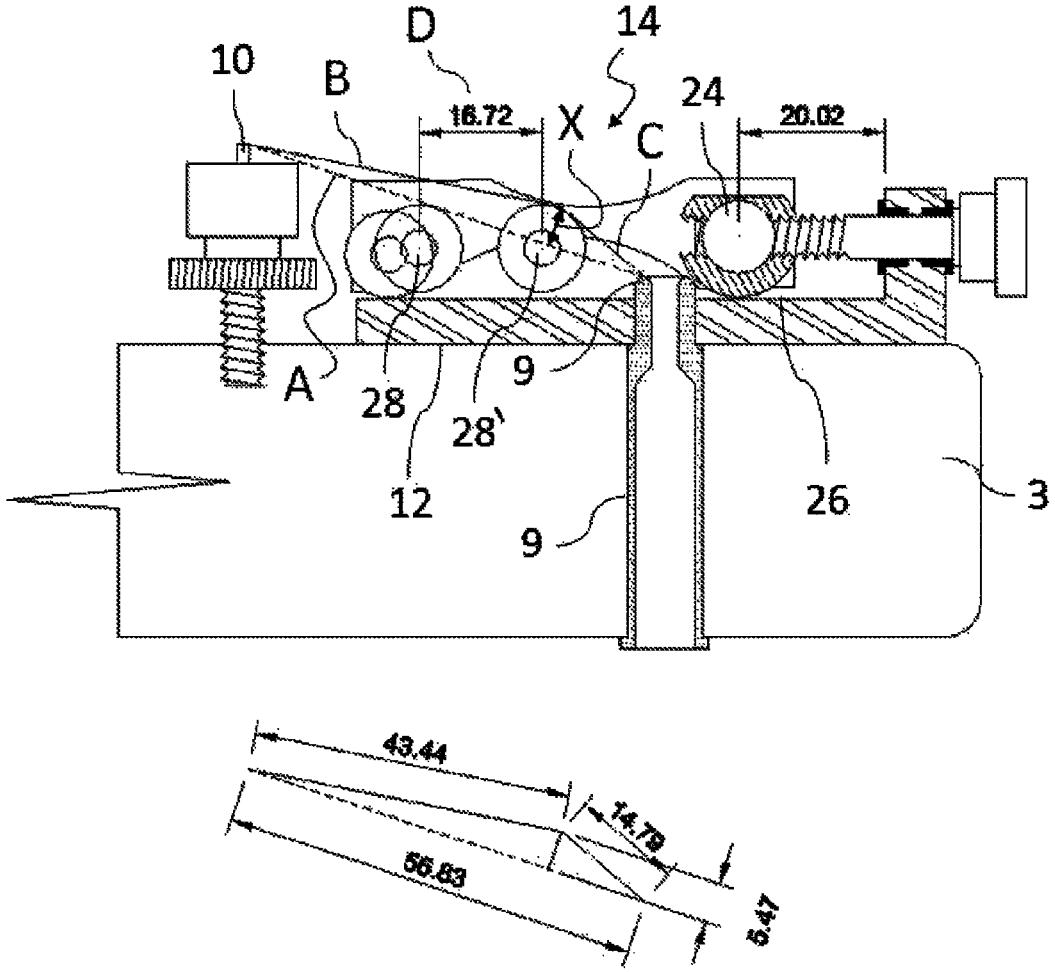
FIG. 8*e* shows a section side elevation of the tuning mechanism of FIG. 8*c* with the string deflector at positions of zero and maximum string deflection.

In brief, FIG. 8*e* shows a composite drawing representing the position of the string deflector (14) through a displacement (D) along the base support surface (26). In more detail, it provides an exploration of the effect of inclination of the string deflector guide surface (15) on the displacement D required to produce a given string extension (B+C) and orthogonal deflection (X).

It is already established from FIG. 8*b* that when the displacement (D) of the string deflector (14) is equal to 10.52 mm, the value of X is 5.47 mm. FIG. 8*e* illustrates what value of D would be required to produce a comparable value of X for an embodiment with a non-inclined string deflector guide surface (15). The start position of the string deflector roller bearing (28) at the position of zero string (5) deflection (i.e. where X=0) corresponds precisely to that shown in FIG. 8*c*. The displaced position of the string deflector roller bearing (28') corresponding to an X value of 5.47 is also shown in FIG. 8*e*. The corresponding numerical values for the ABCX triangles formed, or derived by, the position of the respective string deflectors (14) in FIG. 8*b* and FIG. 8*e* to produce a value of X=5.47 mm are reproduced immediately below the body (3) in FIGS. 8*e* and in table 2.

TABLE 2

| Embodiment | As per FIG. 8a, 8b | As per FIG. 8c, 8d | Δ (absolute) | Δ (%) |
|---|---|---|---|---|
| A | 56.83 | 56.83 | — | — |
| B | 40.50 | 43.44 | — | |
| C | 17.58 | 14.79 | — | |
| B + C | 58.08 | 58.23 | 0.15 | 0.26 |
| (B + C) − A | 1.25 | 1.4 | 0.15 | 12 |
| X | 5.47 | 5.47 | 0 | — |
| D | 10.52 | 16.72 | 6.2 | 59.9 |

It can be seen from the numerical values of Table 2 that to achieve the same value of X for both embodiments, the inclined string deflector guide surface (15) embodiment required an extra displacement (D) of 6.2 mm, which is almost 60% greater than the displacement required by the non-inclined string deflector guide surface (15) embodiment. The string length increase is also higher (by an addition of 12%) for the inclined string deflector guide surface (15) embodiment compared to the non-inclined string deflector guide surface (15) embodiment.

Thus, considering the results from all of FIGS. 8*a-e* and tables 1 and 2, the following can be concluded.

The inclination of the string deflector guide surface (15) with respect to the base support surface (26) results in significantly less (>60%) string deflector (14) displacement (D) required to achieve the same value of string extension ((B+C)−A) and/or orthogonal string (5) deflection (X).

Significantly (~60%) more displacement (D) is required using the non-inclined string deflector guide surface (15) to achieve the same lateral deflection of the string (X);

The displacement (D) in the inclined and non-inclined string deflector guide surface (15) embodiments is respectively over eight times (841.6%) and nearly twelve times (1194.3%) greater than the respective linear extension of the string ((B+C)−A).

The linear extension of the string ((B+C)−A) of the non-inclined string deflector guide surface (15) embodiment is 12% greater than the inclined string deflector guide surface (15) embodiment.

Consequently, it can be appreciated that:

The inclined string deflector guide surface (15) embodiment reduces the length of the base support surface (26) required to accommodate the displacement (D) necessary to tune a given range of pitch adjustment for each string (5). This provides greater opportunity for fitment of the tuning mechanism (1) in the restricted space at the tailpiece of an instrument (2) without need to increase the length of the instrument or use non-standard length string (5) or some other compromise on handling or practicality.

The greater displacement (D) of both the inclined and non-inclined string deflector guide surface (15) embodiments compared to the actual increase ((B+C)−A) in the length of string (5) shows a significantly lower force needs to be applied by the user at any point during an adjustment of the string (5) tension. This will be evident that if it is assumed the work required to extend a string (5) by a given amount is the same irrespective of the mechanism used, it follows from the relationship W=F×D (where W is the work done in extending the string (5), F is the force applied and D is the displacement travelled by the string) that a value of D 8-12 higher than the actual string (5) extension ((B+C−A) for example will require 8-12 times less applied force. This translates into a significant reduction in the effort required by the user to adjust the tuning control (18) during tuning.

To provide context for these measurements, for a recognized industry-standard bass guitar (2) using strings (5) with a 34-inch scale length, there is a space of approximately 50 mm between the bridge (10) and edge of the body (3). Cases intended for such instruments are the most significant commercially. Thus, for a bass guitar (2) to fit within such cases, there is between 50-95 mm (between the bridge (10) and edge of the body (3)) available to fit a tuning mechanism (1). A bass guitar (2) with larger dimensions would not only preclude use with the majority of available bass guitar cases but would also impinging on the widely accepted aesthetics for an electric bass guitar (2).

The above-described embodiments result in a tuning mechanism (1) with an overall length of 62 mm and a string deflector (14) displacement (D) of under 15 mm to provide up to an octave of tuning capability. It will thus be readily appreciated that the above described effects of compaction afforded by inclining the string deflector guide surface (15) are significant.

Figure 9:
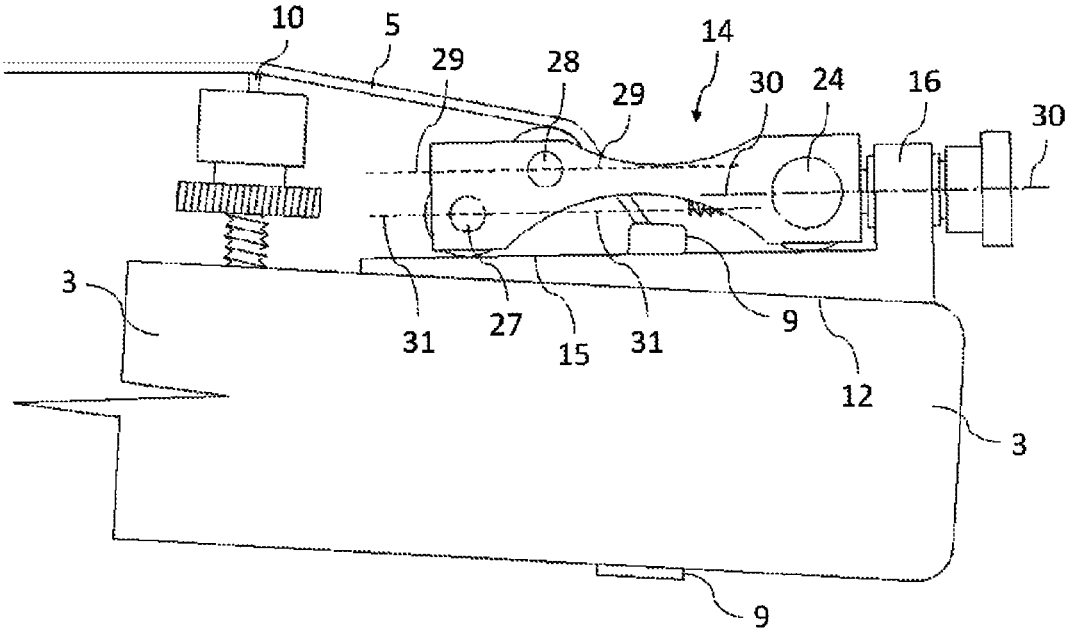
FIG. 9. shows a Side elevation of a third preferred embodiment of the present invention showing a side elevation of the tuning mechanism.

FIG. 9 shows a further embodiment of a fine tuning mechanism (1) substantially similar to that shown in FIGS. 1-8 with the exception that the inclined string deflector guide surface (15) and the base support surface (26) are formed as a continuous plane, inclined with respect to the body (3). Consequently, the path of the sleeve/support bushing (23, 24), ramp roller bearing (27) and string deflection roller bearing (28) are all parallel. The degree of lateral deflection of the string (5) by the string deflector (14) with respect to the linear distance of travel by the carriage is a function of the angle of coincidence of the string deflector guide surface/base support surface (15, 26) (and thus, the deflection path (29)) with the longitudinal axis of the string (5) between the bridge (10) and tailpiece (8).

Figure 10A:
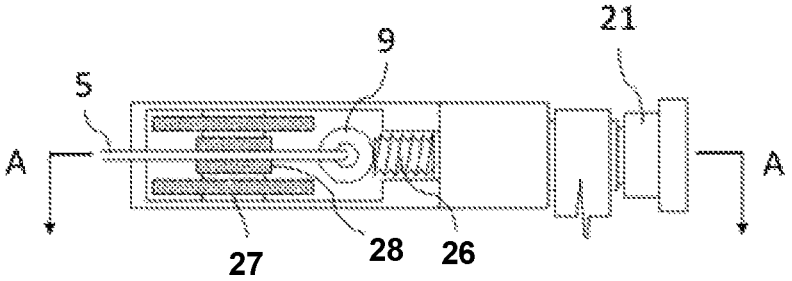
FIG. 10*a* shows a plan view of a fourth preferred embodiment of the present invention of a tuning mechanism showing a plan view of the tuning mechanism.
Figure 10B:
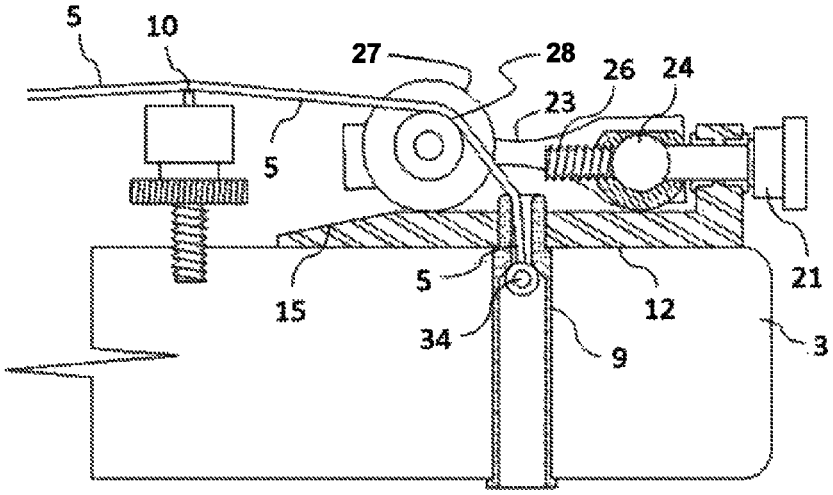
FIG. 10*b*. shows a section side elevation along the section line AA of the embodiment shown in FIG. 10*a;*

FIGS. 10*a* and 10*b* show an alternative embodiment of the present invention in the form of a fine tuning mechanism (1) substantially similar to that shown in FIGS. 1-8, with the exception that the ramp roller bearing (27) and the string deflection roller bearing (28) are mounted coaxially. The embodiment of FIGS. 9*a* and 9*b* show a configuration where the ramp roller bearing (27) is formed as two separate, identically sized bearings mounted either side of the string deflection roller bearing (28) which has a smaller radius than the ramp roller bearing (27). The string (5) is thus able to be engaged by the string deflection roller bearing (28) without any frictional interference with the twin ramp roller bearings (27). A further geometric consequence of the embodiment in FIG. 9 is that the axis of the string deflector guide surface (15) and the deflection path (29) are parallel.

Figure 11A:
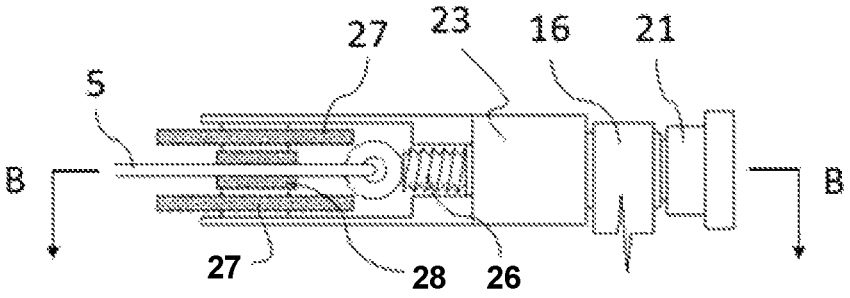
FIG. 11*a* shows a plan view of a fifth preferred embodiment of the present invention of a tuning mechanism showing a plan view of the tuning mechanism.
Figure 11B:
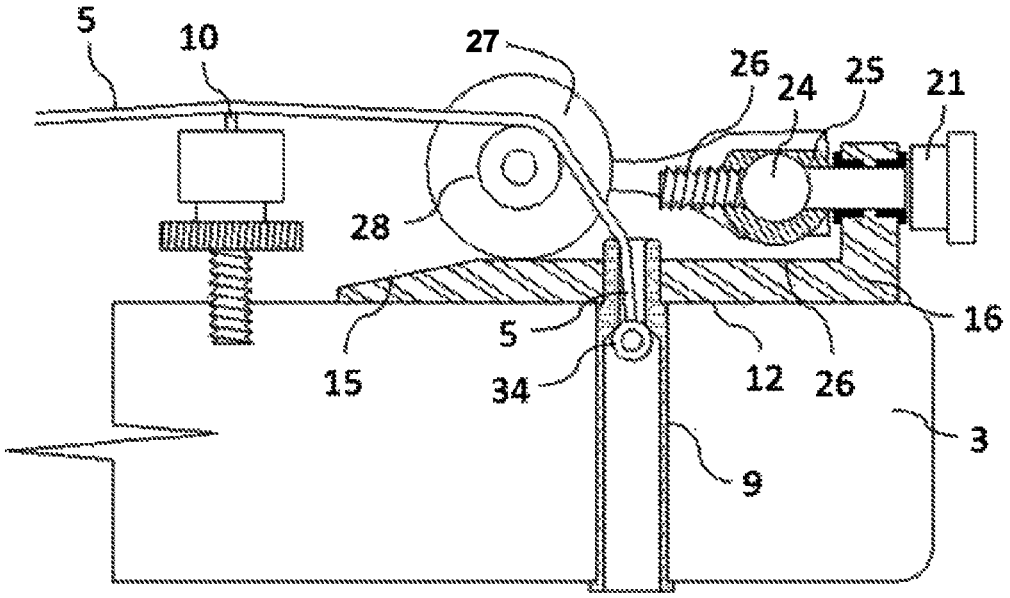
FIG. 11*b*. shows a section side elevation along the section line BB of the embodiment shown in FIG. 11*a;*

FIG. 11 shows a further embodiment of the present invention in the form of a fine tuning mechanism (1) substantially similar to that shown in FIG. 9. However, unlike the previous embodiment, the diameter of the twin ramp roller bearing (27) is sufficient to obviate the need for the support bushing (25) to make contact with the base support surface (26). It will be appreciated such a configuration may also be employed with the other embodiments described herein. Such a combination also provides the advantage that the direction of movement of the sleeve/support bush (24, 25) is aligned with the axis of rotation of the ramp roller bearings/string deflection roller bearing (27, 28) throughout the full range of travel thereby eliminating detrimental twisting forces.

The above-described embodiments of the present invention are configured as a discrete tuning mechanism (1) capable of being fitted to an instrument (2) either during manufacture or retrofitted. However, in a further aspect, the present invention is comprised of an instrument (100) incorporating a tuning mechanism (1). In such embodiments, at least part of the tuning mechanism (1) is formed as an integral part of the instrument body (2).

Figure 12:
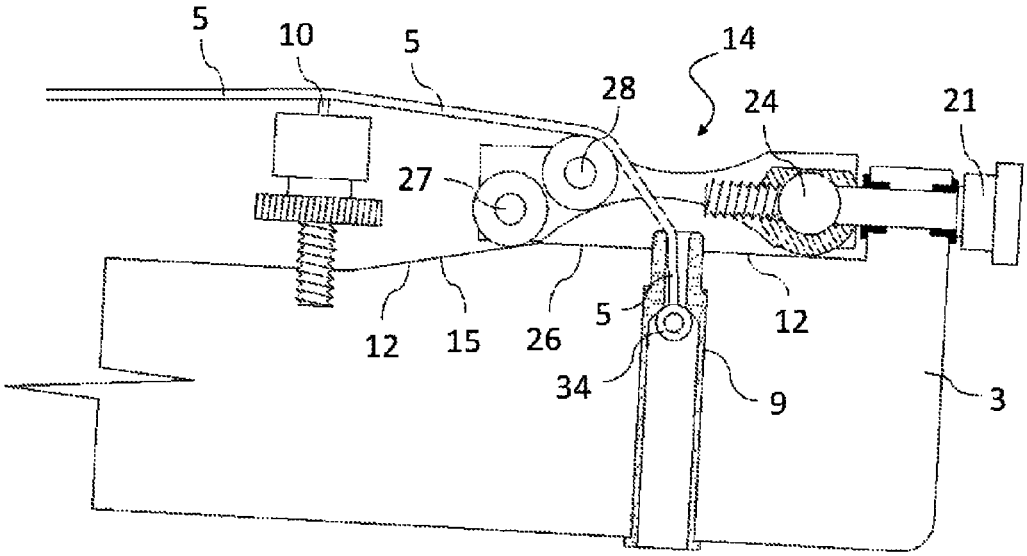
FIG. 12. shows a section side elevation of a sixth preferred embodiment in the form of an instrument with an integrated tuning mechanism.

FIG. 12 shows an embodiment where the housing (16), string deflector guide surface (15) and base support surface (26) are formed as part of the body of a bass guitar (2). In all other regards, the tuning mechanism (1) is configured and operates the same as the tuning mechanism (1) in FIGS. 1-7. It will be appreciated that while FIG. 12 shows the string deflector guide surface (15) and base support surface (26) raised above the upper body surface (12), the invention may be formed as a string instrument (100) with the base support surface (26) orientated substantially planar with the upper body surface (12), with the string deflector guide surface (15) as a recessed inclined ramp.

It will be apparent to one skilled in the art that irrespective of whether the invention is represented as a tuning mechanism (1) or a string instrument (100) incorporating a tuning mechanism (1), not all of the components of the tuning mechanism need be formed as an integral structure. In contrast, the tuning mechanism (1) may be formed with any combination or permutation of the string deflector guide surface (15), tailpiece (8), tensioning mechanism (13), base support surface (26) and/or the bridge (10) being formed as an integral unit or as discrete, individual components and/or formed directly as part of the instrument body (3).

Figure 13:
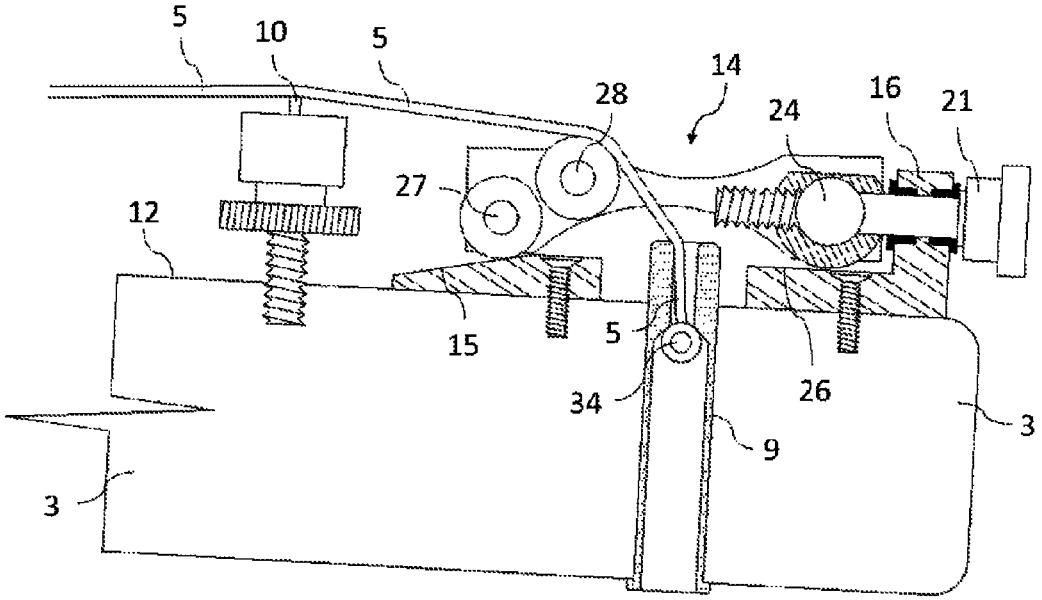
FIG. 13. shows a section side elevation of a seventh preferred embodiment.
Figure 14:
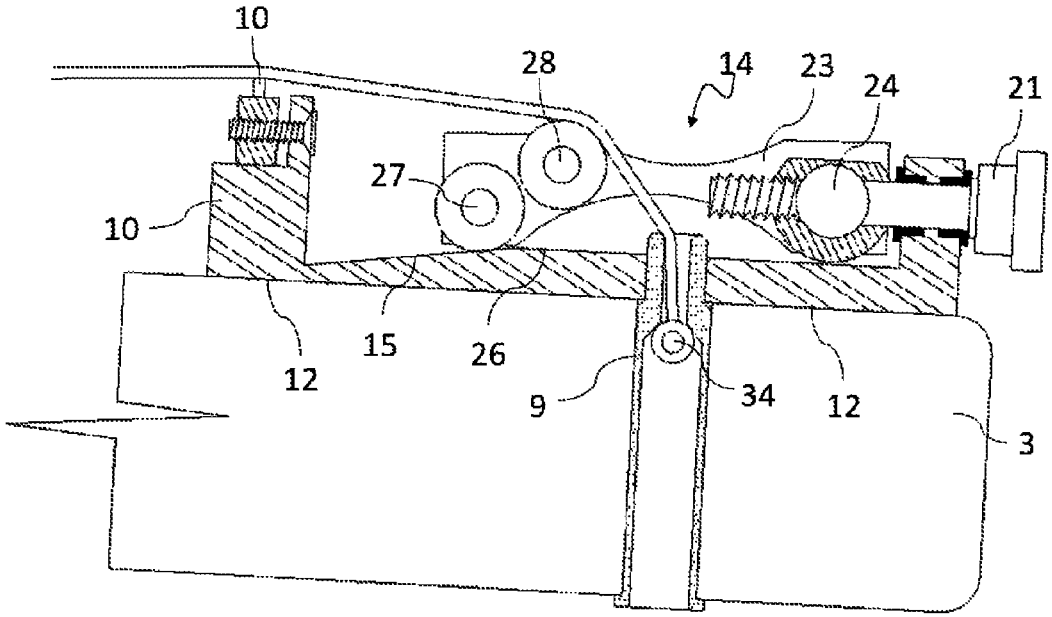
FIG. 14. shows a section side elevation of an eighth preferred embodiment in the form of a tuning mechanism with an integrated bridge.

FIG. 13 and FIG. 14 show two alternative examples of such construction configurations. FIG. 13 shows a fine tuning mechanism (1) substantially similar to that shown in FIGS. 1-8 with the exception that the string deflector guide surface (15) and base support surface (26) are formed as separate elements, individually attached to the upper body surface (12). FIG. 14 also shows fine tuning mechanism (1) substantially similar to that shown in FIGS. 1-8, differing in that the string deflector guide surface (15), base support surface (26) and the bridge (10) are formed as a single structure attached to the upper body surface (12).

Figure 15A:
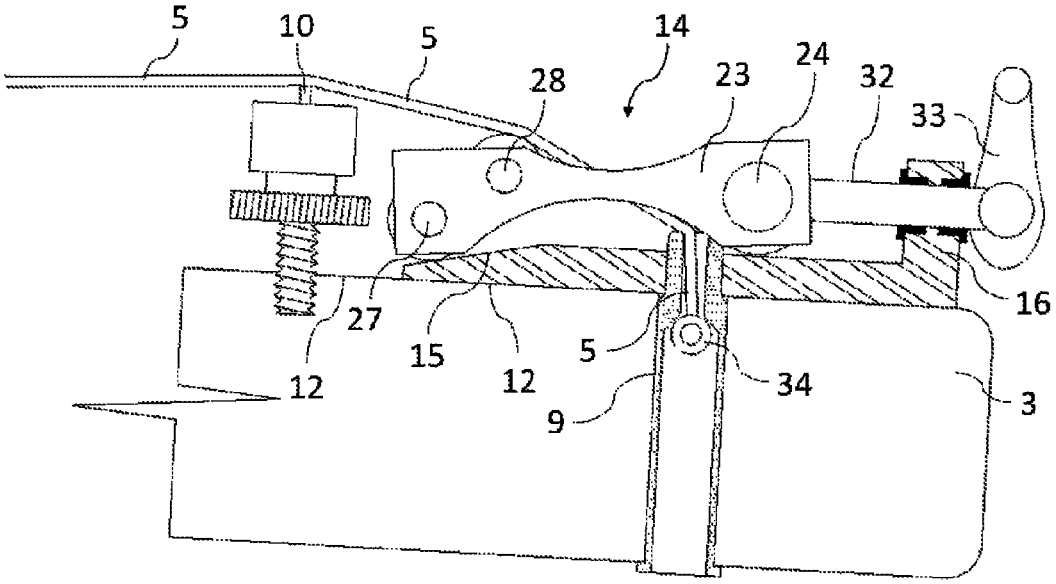
FIG. 15*a* shows a partial section side elevation view of a ninth preferred embodiment of the present invention of a tuning mechanism showing the string deflector in the extended position.
Figure 15B:
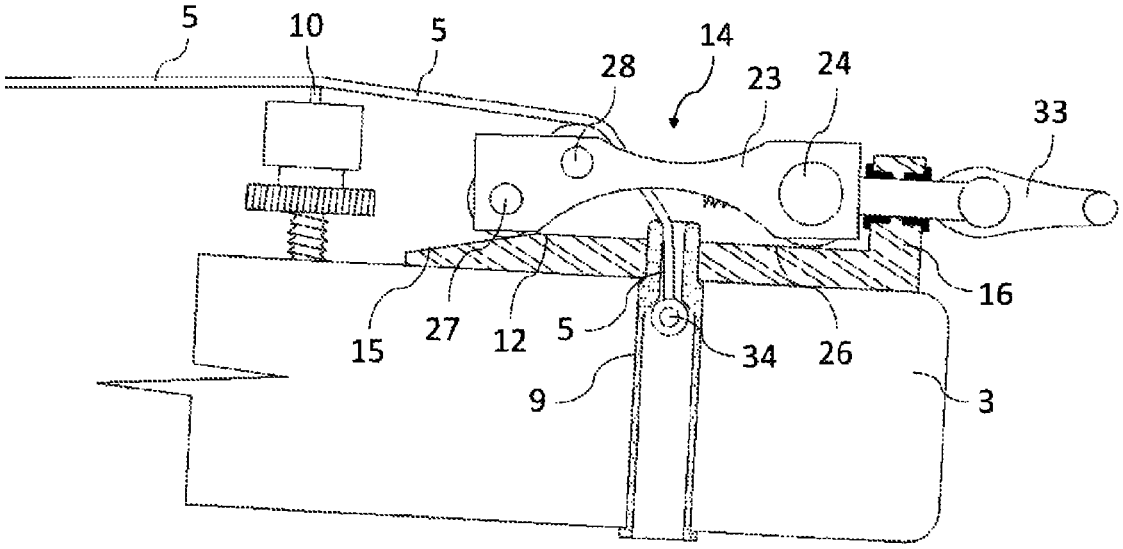
FIG. 15*b*. shows the embodiment of FIG. 15*a* showing the string deflector in the retracted position.

Further alternatives in the construction of the tuning mechanism (1) include the use of an alternative tensioning mechanism (13) as shown in FIGS. 15*a* and 15*b*. In the embodiment of FIG. 15, the constituent components of tuning control (18) shown in the preceding embodiments, i.e. the threaded shaft (20) and knob (21) are respectively replaced by a connecting shaft (32) and a cam lever (33). The connecting shaft (32) passes through an aperture (17) in the housing (16) and is attached at one end to the sleeve (24) and pivotally attached at the other end to the cam lever (33). In FIG. 15*a*, the cam lever (33) is orthogonal to the connecting shaft (32) when the carriage (23) is in the position of maximum extension thereby producing the minimum deflection of the string (5). FIG. 15*b* shows the carriage (23) at the position of maximum retraction at the opposite end of its travel range causing the maximum deflection of the string (5). To effect the retraction of the carriage (23) to this position, the cam lever (33) is rotated through 90° to increase the separation between the outer surface of the lever (33) contacting the housing (16) and the pivot connection with the connection shaft (32).

Figure 16:
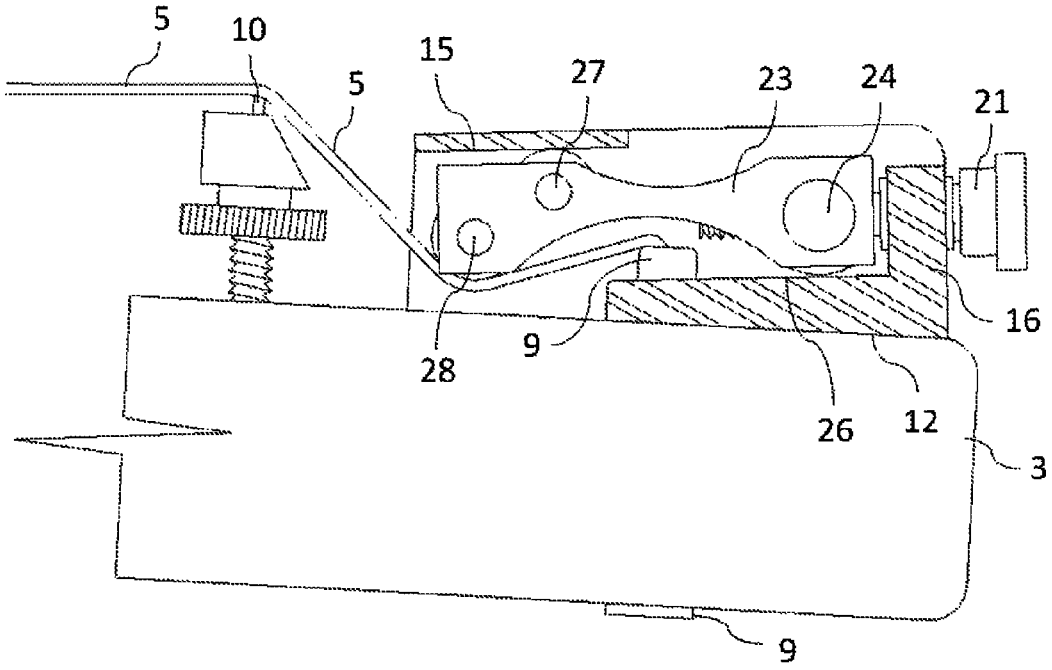
FIG. 16. shows a section side elevation of a tenth preferred embodiment in the form of a tuning mechanism.
Figure 17:
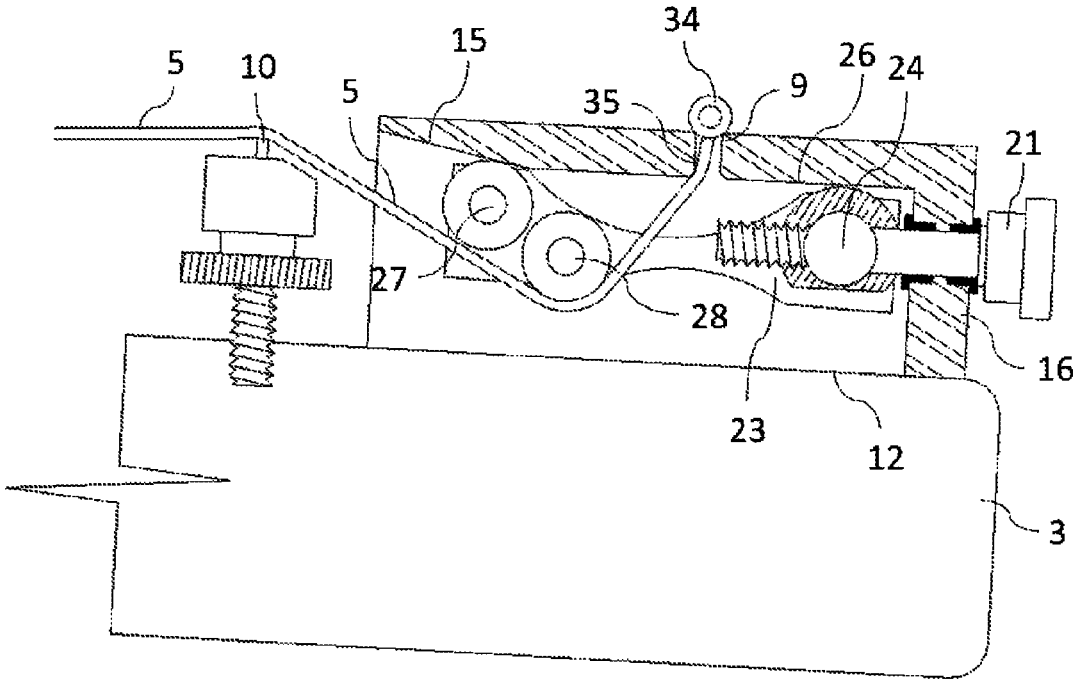
FIG. 17. shows a section side elevation of an eleventh preferred embodiment in the form of a tuning mechanism.

In the embodiments shown in FIGS. 1-15, the string (5) deflection is generated by movement of the string deflector (14) acting on the string (5) along a deflection path (29) in a direction away from the body (3) and headstock (6) of the bass (2). However, the present invention is not restricted to laterally deflecting the string (5) from only one direction. FIGS. 16 and 17 show two further alternative tuning mechanism (1) embodiments where string (5) deflection is generated by movement of the string deflector (14) acting on the string (5) along a deflection path (29) in a direction towards the body (3) and headstock (6) of the bass (2).

In FIG. 16, the position of the ramp roller bearing (27) and the string deflector roller bearing (28) are reversed in comparison to the embodiments shown in FIGS. 1-9 and 12-15. The string deflector guide surface (15) is located and orientated above the string (5) and inclined downwards towards the body (3) in the direction from the housing (16) towards the headstock (6). The string deflector guide surface (15) is attached to the top of a support wall (34) located laterally to the string (5). As the string deflector (14) is extended towards the bridge (10) during tuning adjustments, the string deflector roller bearing (28) successively presses down on the string (5) increasing its lateral deflection. In the embodiment shown in FIG. 16, it can be seen that as the string deflector guide surface (15) and the base support surface (26) are parallel, the deflection path (29) and tension adjustment axis (30) are also parallel. In contrast to the preceding embodiments, the tension on the string (5) is increased by extending the string deflector (14) towards the headstock (6).

FIG. 17 shows a further tuning mechanism (1) embodiment in which the position and orientation of the string deflector guide surface (15), carriage (23), base support surface (26) and retainer (9) shown in the embodiments in FIGS. 1-7 is inverted. The string deflector guide surface (15) and base support surface (26) are formed as a single continuous structure attached to the upper portion of the housing (16). The string retainer (9) is still located in an aperture in the base support surface (26), though not through the body (3) as in the preceding embodiments. In operation, the tuning mechanism (1) still functions the same as the embodiment in FIGS. 1-7, with the exception that the string deflector roller bearing (28) engages the string (5) on the opposing side. It also allows the tuning mechanism (1) to be fitted at the tailpiece of a bass without needing to drill holes for the string retainers (9) through the body (3).

It will be noted that in the embodiment of FIG. 17, all the string retainers (9) forming the tailpiece (8) are formed as an integral part of the tuning mechanism (1). Instead of the retainer (9) being an individual fitting inserted into the base support surface (26), The retainers (9) are each formed as shaped recess extending from the base support surface apertures (35) through the base support surface (26).

It will understood from the above description and the embodiments illustrated with respect to the drawings that the present invention may be expressed in many differing forms. It may be represented as a complete instrument (100) with a fine tuning mechanism (1) or as a separate tuning mechanism which may be fitted, or retro fitted to an existing instrument (2).

In the above described embodiments, the tuning mechanism (1) utilises standard guitar or bass guitar strings (5) which are typically sold with a ball end (34) enabling them to be secured to the instrument in a simple retainer (9) without the need for exotic of proprietary fittings.

In the embodiments shown in FIGS. 1-17, the retainer also serves to as a means of securing the tuning mechanism (1) (via the base support surface (26)) to the base (2). Each retainer is inserted through apertures in the body (3) to then project through a series of corresponding base support surface apertures (35). The portions of the retainers projecting beyond the upper surface of the base support surface (26) also act as a travel stop for the string deflector (14) by making contact with support bushing (25). The tuning mechanism (1) may therefore be readily fitted to a wide variety of existing instruments by simply drilling the appropriate holes for the string retainers (9).

Aspects of the present invention have been described by way of example only and it should be appreciated that modifications and additions may be made thereto without departing from the scope thereof.

The invention claimed is:

1. A tuning mechanism for a stringed instrument, the stringed instrument including:

a body;

a substantially elongate neck extending from the body;

a plurality of elongate strings, each string secured to a headstock at a distal end of the neck by a headstock string retainer and to the body by a body string retainer, said strings being tensioned over a span formed between a first and a second string supports, respectively located on the body and at, or adjacent, said headstock;

a tailpiece formed from a plurality of body string retainers;

said tuning mechanism including:

a string deflector guide surface, a manually adjustable tensioning mechanism, locatable on the body and connected to at least one movable string deflector, contacting a string between said first string support and the tailpiece along a deflection path coincident with the longitudinal axis of the string between said first string support and the tailpiece, said string deflector including:

a first roller bearing providing rolling contact between the string deflector and the string deflector guide surface, and a second roller bearing providing rolling contact between the string deflector and the string between the first string support and the tailpiece along said deflection path, wherein, said first and second roller bearings mutually contra-rotate in use as the string deflector moves along the string deflector guide surface and for each string, manual adjustment of the tensioning mechanism produces a commensurate movement of the string deflector generating lateral deflection of the string along the deflection path from contact with the string deflector, said commensurate movement of the string deflector being at least partially along the string deflector guide surface.

2. A tuning mechanism as claimed in claim 1, wherein each string is orientationally realigned about said first string support such that each string's longitudinal axis a. between the tailpiece and the first string support, and b. between the first and second string supports, are non-coaxial and non-parallel.

3. A tuning mechanism as claimed in claim 1, wherein the string deflector guide surface is rigidly connected to the tensioning mechanism by a base support surface mounted on, and substantially parallel with, an upper surface of the body.

4. A tuning mechanism as claimed in claim 1, including a base support surface at least partially separated from the string deflector guide surface and/or the tensioning mechanism.

5. A tuning mechanism as claimed in claim 1, wherein said string deflector guide surface is formed as a ramp, inclined toward the surface of the body in a direction facing towards the headstock.

6. A tuning mechanism as claimed in claim 1, wherein said string deflector is formed as a carriage.

7. A tuning mechanism as claimed in claim 1, wherein said string deflector further includes a third roller bearing providing rolling contact between the string deflector and the base support surface.

8. A tuning mechanism as claimed in claim 1, wherein said string deflector guide surface and the deflection path are collinear and said first and second roller bearings each have an axis of rotation in a common plane substantially parallel with the string deflector guide surface.

9. A tuning mechanism as claimed in claim 1, wherein said string deflector guide surface and the deflection path are non-collinear and said first and second roller bearings each have an axis of rotation in a common plane, substantially non-parallel with the string deflector guide surface.

10. A tuning mechanism as claimed in claim 1, wherein, said string deflector further includes a sliding contact surface providing sliding contact between the string deflector and the base support surface.

11. A tuning mechanism as claimed in claim 1, wherein said tensioning mechanism is configured with a fixed fitting attached to the body, said fitting including, for each string, a tensioner in the form of a manually rotatable tuning control with a screw threaded connection to a corresponding string deflector, and adjustment of a said tensioner by rotation of the screw threaded connection to a string deflector causes at least part of the string deflector to move linearly along a tension adjustment axis.

12. A tuning mechanism as claimed in claim 11, wherein said tensioning mechanism fixed fitting is configured as a rigid housing, apertured with individual threaded passageways to accept a corresponding screw threaded rotatable tuning control for each string.

13. A tuning mechanism as claimed in claim 11, wherein a said rotatable tuning control is mounted on a pair of axial bearings.

14. A tuning mechanism as claimed in claim 11, wherein said tensioning mechanism is connected to the string deflector via said screw threaded connection to an internally threaded sleeve, pivotally attached to said string deflector about a sleeve pivot axis substantially orthogonal to the axis of said screw threaded connection.

15. A tuning mechanism as claimed in claim 1, wherein the tailpiece includes at least one body string retainer incorporated as part of the tuning mechanism, thereby providing a means for retaining the end of each string to the body.

16. A tuning mechanism as claimed in claim 15, wherein said body string retainer protrudes above the base support surface to provide a travel stop for the string deflector.

17. A tuning mechanism as claimed in claim 1, wherein said first string support is incorporated as part of the tuning mechanism.

18. A tuning mechanism as claimed in claim 1, wherein said tuning mechanism is rigidly attached to said instrument body.

19. A tuning mechanism as claimed in claim 1, wherein said tuning mechanism is non-pivotable about said body upper surface.

20. A musical instrument including a tuning mechanism as claimed in claim 1, said instrument including:

a body;

a substantially elongate neck extending from the body;

a plurality of elongate strings, each secured to a headstock at the distal end of the neck by a headstock string retainer and to the body by a body string retainer, said strings being tensioned over a span formed between a first and second string support, respectively located on the body and at, or adjacent, said headstock;

a tailpiece formed from a plurality of body string retainers;

each string being orientationally realigned about said first string support such that each string's longitudinal axis between the tailpiece and the first string support and between the first and second string supports are non-coaxial and non-parallel, wherein said tuning mechanism includes:

a manually adjustable tensioning mechanism, located on the body and connected to, at least one movable string deflector, contacting a string between said first string support and the tailpiece along a deflection path coincident with the longitudinal axis of the string between said first string support and the tailpiece;

characterised in that;

for each string, manual adjustment of the tensioning mechanism produces a commensurate movement of the string deflector generating lateral deflection of the string along the deflection path from contact with the string deflector.

* * * * *